US006034478A

United States Patent [19]

Kawade et al.

[11] Patent Number: 6,034,478

[45] Date of Patent: Mar. 7, 2000

[54] ELECTRON-EMITTING DEVICE AND ELECTRON SOURCE AND IMAGE-FORMING APPARATUS USING THE SAME AS WELL AS METHOD OF MANUFACTURING THE SAME

[75] Inventors: Hisaaki Kawade, Yokohama; Masato Yamanobe, Machida; Keisuke Yamamoto, Yamato; Yasuhiro Hamamoto, Machida; Masanori Mitome, Yokohama, all of Japan

[73] Assignee: Canon Kabushiki Kaisha, Tokyo, Japan

[21] Appl. No.: 08/614,894

[22] Filed: Mar. 13, 1996

[30] Foreign Application Priority Data

| | | | |
|---|---|---|---|
| Mar. 13, 1995 | [JP] | Japan | 7-079402 |
| Mar. 5, 1996 | [JP] | Japan | 8-073074 |
| Mar. 13, 1996 | [JP] | Japan | 8-083071 |

[51] Int. Cl.[7] ..... H05B 37/02

[52] U.S. Cl. ..... 315/169.1; 345/74

[58] Field of Search ..... 315/169.1; 345/74

[56] References Cited

U.S. PATENT DOCUMENTS

| | | | |
|---|---|---|---|
| 5,470,265 | 11/1995 | Nomura et al. | 445/24 |
| 5,659,328 | 8/1997 | Todokoro et al. | 345/47 |

FOREIGN PATENT DOCUMENTS

| | | |
|---|---|---|
| 0536732 | 4/1993 | European Pat. Off. . |
| 0660357 | 6/1995 | European Pat. Off. . |
| 0693766 | 1/1996 | European Pat. Off. . |
| 7-235255 | 9/1995 | Japan . |

OTHER PUBLICATIONS

Dyke, W.P., et al, "Field Emission," Advances in Electronics and Electron Physics, vol. VIII, Academic Press Inc., Publishers, 1956, pp. 89–185.

Mead, C.A., "Operation of Tunnel–Emission Devices," Journal of Applied Physics, vol. 32, No. 4, Apr. 1961, pp. 646–652.

Elinson, M.L., et al, "The Emission of Hot Electrons and the Field Emission of Electrons from Tin Oxide," Radio Engineering and Electronic Physics, No. 7, Jul. 1965, pp. 1290–1296.

Dittmer, G., "Electrical Conduction and Electron Emission of Discontinuous Thin Films," Thin Solid Films—Elsevier Sequoia S.A., Lausanne, Switzerland, Jul. 4, 1971, pp. 317–329.

Hartwell, M, et al, "Strong Electron Emission from Patterned Tin–Indium Oxide Thin Films," International Electron Devices meeting, Washington, D.C., 1975, pp. 519–521.

Spindt, C.A., et al., "Physical properties of thin–film field emission cathodes with molybdenum cones," Journal of Applied Physics, vol. 47, No. 12, Dec. 1976, pp. 5248–5263.

*Primary Examiner*—Michael B Shingleton

*Attorney, Agent, or Firm*—Fitzpatrick, Cella, Harper & Scinto

[57] ABSTRACT

An electron-emitting device comprises a pair of electrodes arranged on a substrate and an electroconductive film connecting said electrodes and having an electron-emitting region formed therein. The electron-emitting region contains a fissure having an even width of less than 50 nm and preferably shows a voltage applicable length of less than 5 nm. An electron source comprising a plurality of such electron-emitting devices is capable of realizing uniform electron beam emission and an image-forming apparatus comprising such an electron source is suitable for high resolution image display.

10 Claims, 19 Drawing Sheets

ELECTRON-EMITTING DEVICE AND ELECTRON SOURCE AND IMAGE-FORMING APPARATUS USING THE SAME AS WELL AS METHOD OF MANUFACTURING THE SAME

BACKGROUND OF THE INVENTION

1. Field of the Invention

This invention relates to an electron-emitting device and also to an electron source and an image-forming apparatus using the same as well as to a method of manufacturing the same.

2. Related Background Art

There have been known two types of electron-emitting device; the thermionic cathode type and the cold cathode type. Of these, the cold cathode type refers to devices including field emission type (hereinafter referred to as the FE type) devices, metal/insulation layer/metal type (hereinafter referred to as the MIM type) electron-emitting devices and surface conduction electron-emitting devices. Examples of FE type device include those proposed by W. P. Dyke & W. W. Dolan, "Field emission", Advance in Electron Physics, 8, 89 (1956) and C. A. Spindt, "PHYSICAL Properties of thin-film field emission cathodes with molybdenum cones", J. Appl. Phys., 47, 5248 (1976).

Examples of MIM device are disclosed in papers including C. A. Mead, "Operation of Tunnel-Emission Device", J. Appl. Phys., 32, 646 (1961).

Examples of surface conduction electron-emitting device include one proposed by M. I. Elinson, Radio Eng. Electron Phys., 10 (1965).

A surface conduction electron-emitting device is realized by utilizing the phenomenon that electrons are emitted out of a small thin film formed on a substrate when an electric current is forced to flow in parallel with the film surface. While Elinson proposes the use of $SnO_2$ thin film for a device of this type, the use of Au thin film is proposed in G. Dittmer, "Thin Solid Films", 9, 317 (1972) whereas the use of $In_2O_3/SnO_2$ and that of carbon thin film are discussed respectively in M. Hartwell and C. G. Fonstad, "IEEE Trans. ED Conf.", 519 (1975) and H. Araki et al., "Vacuum", Vol. 26, No. 1, p. 22 (1983).

FIG. 18 of the accompanying drawings schematically illustrates a typical surface conduction electron-emitting device proposed by M. Hartwell. In FIG. 18, reference numeral 1201 denotes a substrate. Reference numeral 1203 denotes an electroconductive thin film normally prepared by producing an H-shaped thin metal oxide film by means of sputtering, part of which eventually makes an electron-emitting region 1202 when it is subjected to a current conduction treatment referred to as "energization forming" as will be described hereinafter. In FIG. 18, the narrow film arranged between a pair of device electrodes has a length L of 0.5 to 1 mm and a width W' of 0.1 mm.

Conventionally, an electron-emitting region 1202 is produced in a surface conduction electron-emitting device by subjecting the electroconductive thin film 1203 of the device to a current conduction treatment, which is referred to as "energization forming". In an energization forming process, a constant DC voltage or a slowly rising DC voltage that rises typically at a rate of 1V/min is applied to given opposite ends of the electroconductive thin film 1203 to partly destroy, deform or transform the film and produce an electron-emitting region 1202 which is electrically highly resistive. Thus, the electron-emitting region 1202 is part of the electroconductive thin film 1203 that typically contains a fissure or fissures therein so that electrons may be emitted from the fissure. Note that, once subjected to an energization forming process, a surface conduction electron-emitting device comes to emit electrons from its electron-emitting region 1202 whenever an appropriate voltage is applied to the electroconductive thin film 1203 to make an electric current run through the device.

Known surface conduction electron-emitting devices include, beside the above described M. Hartwell's device, the one proposed in Japanese Patent Application No. 6-141670 is prepared by arranging a pair of oppositely disposed device electrodes of an electroconductive material and an independent electroconductive thin film connecting the electrodes on an insulating substrate and subjecting them to energization forming to produce an electron-emitting region. The patent document also discloses that techniques that can be used for energization forming include that of applying a pulse voltage to the electron-emitting device and the wave height of the pulse voltage is gradually raised.

There is a consistent demand for electron-emitting devices that operate uniformly and stably for electron emission when used in an image-forming apparatus so that it may be free from the problem of uneven brightness of pixels and produce stabilized images.

However, the above described Hartwell's electron-emitting device is not necessarily satisfactory in terms of uniformity and stability of electron emission.

The electron-emitting region of the device is formed by energization forming as described above but, after it is formed by energization forming, it shows an uneven and unstable profile over the entire region.

When such devices are arranged on a substrate to form an electron source of an image-forming apparatus, the electron-emitting regions of the devices will be uneven in terms of profile and electron-emitting performance as a matter of course and it will be difficult to obtain an electron source that operates uniformly and stably for electron emission. By the same token, an image-forming apparatus comprising such an electron source may not be expected to operate uniformly and stably.

There has been reports on an improved method of manufacturing a surface conduction electron-emitting device that solves the above identified problem to a considerable extent and hence can be used for manufacturing an electron source comprising such devices as well as for an image-forming apparatus comprising such an electron source. The above cited patent document also describes such an improved device.

However, in order to achieve a higher degree of applicability and adaptability for surface conduction electron-emitting devices, they have to show a further improved electron-emitting performance in terms of uniformity and stability. In particular, in the process of manufacturing an electron source by arranging a large number of surface conduction electron-emitting devices, relatively large power has to be consumed for energization forming for producing electron-emitting regions in the devices. This means that a large electric current runs through wires, which on their part resist the electric current flowing therethrough and consequently pull down the voltage until the effective voltage applied to the electron-emitting devices for energization forming significantly varies from device to device to make the devices show levels of electron-emitting performance that fluctuate considerably.

Additionally, because of the large power used for forming electron-emitting regions, they do not necessarily come out in good shape particularly from the viewpoint of electron-emitting efficiency.

SUMMARY OF THE INVENTION

In view of the above identified technological problems, it is, therefore, an object of the present invention to provide an electron-emitting device that operates stably and uniformly. It is another object of the invention to provide an electron-emitting device that shows an excellent electron-emitting efficiency. It is still another object of the invention to provide an image-forming apparatus that operates stably and uniformly for producing fine and clear images.

According to a first aspect of the invention, there is provided a surface conduction electron-emitting device comprising a pair of device electrodes arranged on a substrate and an electroconductive thin film connecting the device electrodes and having an electron-emitting region formed therein, characterized in that a fissure having an even width of less than 50 nm is formed in the electron-emitting region.

Preferably, such a surface conduction electron-emitting device shows a voltage applicable length of less than 5 nm in the electron-emitting region.

A surface conduction electron-emitting device according to the invention may be of a plane type having the pair of device electrodes arranged on a same plane.

Alternatively, a surface conduction electron-emitting device according to the invention may be of a step type having the pair of device electrodes arranged one on the other with an insulation layer disposed therebetween and the electroconductive thin film including the electron-emitting region arranged on a lateral side of the insulation layer.

According to a second aspect of the invention, there is provided a method of manufacturing a surface conduction electron-emitting device comprising an energization forming step, characterized in that the energization forming step is conducted in an atmosphere containing a substance that promotes the cohesion of the electroconductive thin film.

According to a third aspect of the invention, there is provided a method of manufacturing a surface conduction electron-emitting device comprising an energization forming step, characterized in that the energization forming step is conducted to produce an electron-emitting region by applying for a given period of time a pulse wave voltage having a peak value that reduces the resistance and/or initiates the cohesion of the electroconductive thin film.

When the process of energization forming is conducted by applying a pulse wave voltage having a gradually increasing peak value to the electroconductive thin film made of PdO fine particles of an electron-emitting device in vacuum as disclosed in the above cited Japanese Patent Application No. 6-141670, the resistance of the device increases as the peak value of the applied pulse voltage is raised until the pulse peak value gets to $V_{form}$, when the energization forming process is terminated.

As a pulse voltage is applied between the device electrodes to cause an electric current to flow through the electroconductive thin film, heat is generated in the electroconductive thin film to raise the temperature of the electroconductive thin film. If a large amount of heat is generated there, the electroconductive thin film is partly deformed and/or transformed to give rise to a large resistance. However, if the generated heat is not very large, the material of the electroconductive thin film gradually coheres. If the electroconductive thin film is made of a metal oxide such as PbO that is a relatively easily reducible substance, chemical reduction takes place concurrently. The initial fall and the subsequent rise of resistance after the peak value of the pulse wave exceeds Vs may be a net result of two conflicting effects of a fall of resistance due to chemical reduction and an increase of resistance due to ruptured current paths brought forth by the cohesion of the material.

When the electroconductive thin film is made of metal, the fall of resistance is small if compared with an electroconductive thin film made of a metal oxide but the film behaves almost same as a film of a metal oxide. While the cause of the fall of resistance in the case of a electroconductive thin film made of metal is to be investigated, the inventors of the present invention assume that fine metal particles or fine and crystalline metal particles constituting the thin film may partly lose their contact resistance as the voltage applied thereto is increased. In any case, the material of the electroconductive thin film seems to cohere as the peak value of the pulse voltage applied thereto exceeds Vs. The actual value of Vs is determined as a function of the pulse width and the pulse interval of the pulse voltage as well as of the resistance and the material of the electroconductive thin film.

The voltage level at which the electroconductive thin film starts partly losing its resistance and/or cohering is greater than Vs and much smaller than $V_{form}$.

For the energization forming process, the peak of the pulse voltage applied to the electroconductive thin film may be gradually increased from a low level and held to a constant level once it gets to that level or it may be held to a constant level for a given period of time from the very beginning.

In a method of manufacturing a surface conduction electron-emitting device according to the third aspect of the invention and comprising an energization forming step, the energization forming step preferably consists in application of a pulse voltage to the device, the peak of the applied pulse voltage being held to the level at which the electroconductive thin film starts partly losing its resistance and/or cohering for a predetermined period of time, followed by an enlarged pulse width and/or a raised pulse peak level of the pulse voltage.

Preferably, said energization forming step is conducted in an atmosphere containing a gas that promotes the cohesion of the electroconductive thin film.

According to a fourth aspect of the invention, there is provided an electron source comprising a plurality of electron-emitting devices arranged on a substrate.

Preferably, an electron source according to the fourth aspect of the invention comprises at least a row of electron-emitting devices and wires arranged in the form of a matrix for driving the electron-emitting devices.

Alternatively, an electron source according to the fourth aspect of the invention may comprise at least a row of electron-emitting devices and wires arranged in a ladder-like form for driving the electron-emitting devices.

According to a fifth aspect of the invention, there is provided an image-forming apparatus comprising an electron source according to the fourth aspect of the invention and an image-forming member for producing images by electron beams emitted from the electron source.

According to a sixth aspect of the invention, there is provided a method of manufacturing an electron source and an image-forming apparatus incorporating such an electron source, said method comprising an energization forming step to be conducted on surface conduction electron-emitting devices, characterized in that the energization forming step is conducted in an atmosphere containing a gas that promotes the cohesion of the electroconductive thin film.

According to a seventh aspect of the invention, there is provided a method of manufacturing an electron source and an image-forming apparatus incorporating such an electron source, said method comprising an energization forming step to be conducted on surface conduction electron-emitting devices, characterized in a that the energization forming step consists in application of a pulse voltage to the device, the peak of the applied pulse voltage being raised to the level at which the electroconductive thin film starts partly losing its resistance and/or cohering and thereafter held to that level for a predetermined period of time.

In a method of manufacturing an electron source and an image-forming apparatus incorporating such an electron source according to the seventh aspect of the invention, said method comprising an energization forming step to be conducted on surface conduction electron-emitting devices, the energization forming step preferably consists in application of a pulse voltage to the device, the peak of the applied pulse voltage being held to the level at which the electroconductive thin film starts partly losing its resistance and/or cohering for a predetermined period of time, followed by an enlarged pulse width and/or a raised pulse peak level of the pulse voltage.

Preferably, said energization forming step is conducted in an atmosphere containing a gas that promotes the cohesion of the electroconductive thin film.

In a preferred mode of carrying out a method according to the seventh aspect of the invention, a pulse voltage is applied to the electron-emitting devices of a row selected by a row selection means for selecting different rows on a one by one basis until all the electron-emitting devices of all the rows are subjected to energization forming.

With a method of manufacturing an electron source and an image-forming apparatus incorporating such an electron source, all the surface conduction electron-emitting devices of the electron source operate uniformly and stable for electron emission.

An electron source and an image-forming apparatus comprising such an electron source according to the invention are free from the problem of uneven brightness of pixels and produce stabilized images.

DESCRIPTION OF THE PREFERRED EMBODIMENTS

A surface conduction electron-emitting device according to the invention may be either of a plane type or of a step type.

Firstly, a surface conduction electron-emitting device of a plane type will be described.

Figure 1A:
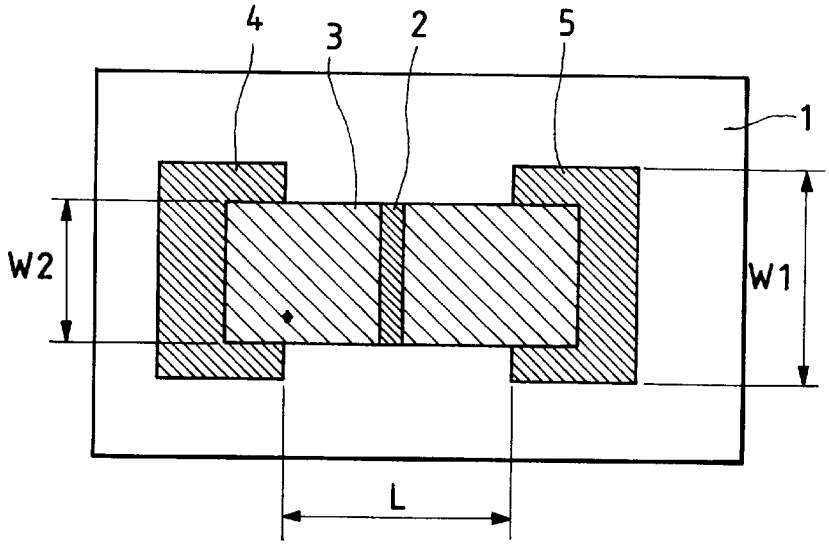
FIGS. 1A and 1B are a schematic plan view and a schematic cross sectional view of a plane type surface conduction electron-emitting device according to the invention.
Figure 1B:
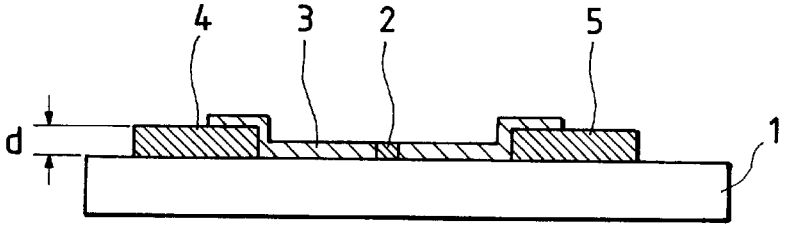

FIGS. 1A and 1B are a schematic plan view and a schematic cross sectional view of a plane type surface conduction electron-emitting device according to the invention.

The substrate 1 can comprise quartz glass, glass containing impurities such as Na to a reduced concentration level, soda lime glass, glass substrate realized by forming an $SiO_2$ layer on soda lime glass by means of sputtering, ceramic substances such as alumina or Si.

While the oppositely arranged lower and higher potential side device electrodes 4 and 5 may be made of any highly conducting material, preferred candidate materials include metals such as Ni, Cr, Au, Mo, W, Pt, Ti, Al, Cu and Pd and their alloys, printed conducting materials made of a metal or a metal oxide selected from Pd, Ag, $RuO_2$, Pd—Ag, etc. with glass, transparent conducting materials such as $In_2O_3$—$SnO_2$ and semiconductor materials such as polysilicon.

Referring to FIGS. 1A and 1B, the distance L separating the device electrodes, the length W1 of the device electrodes, the width W2 of the electroconductive thin film 3 and the height d of the device electrodes and other factors for designing a surface conduction electron-emitting device according to the invention may be determined depending on the application of the device. The distance L separating the device electrodes 4 and 5 is preferably between hundreds nanometers and hundreds micrometers and, still preferably, between several micrometers and tens of several micrometers depending on the voltage to be applied to the device electrodes.

The length W1 of the device electrodes is preferably between several micrometers and hundreds of several micrometers depending on the resistance of the electrodes and the electron-emitting characteristics of the device. The film thickness d of the device electrodes 4 and 5 is between tens of several nanometers and several micrometers.

A surface conduction electron-emitting device according to the invention may have a configuration other than the one illustrated in FIGS. 1A and 1B and, alternatively, it may be prepared by sequentially laying an electroconductive thin film 3 and oppositely disposed device electrodes 4 and 5 on a substrate 1.

The electroconductive thin film 3 is preferably a fine particle film in order to provide excellent electron-emitting characteristics. The thickness of the electroconductive thin film 3 is determined as a function of the stepped coverage of the electroconductive thin film on the device electrodes 4 and 5, the electric resistance between the device electrodes 4 and 5 and the parameters for the forming operation that will be described later as well as other factors and preferably between a tenth of several nanometers and hundreds of several nanometers and more preferably between a nanometer and fifty nanometers. The electroconductive thin film 3 normally shows a sheet resistance Rs between $10^2$ and $10^7\Omega/\square$. Note that Rs is the resistance defined by $R=Rs(l/w)$, where w and l are the width and the length of a thin film respectively and R is the resistance determined along the longitudinal direction of the thin film.

The electroconductive thin film 3 is made of a material selected from metals such as Pd, Pt, Ru, Ag, Au, Ti, In, Cu, Cr, Fe, Zn, Sn, Ta and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such as TiC, ZrC, HfC, TaC, SiC and WC, nitrides such as TiN, ZrN and HfN, semiconductors such as Si and Ge and carbon.

The term a "fine particle film" as used herein refers to a thin film constituted of a large number of fine particles that may be loosely dispersed, tightly arranged or mutually and randomly overlapping (to form an island structure under certain conditions). The diameter of fine particles to be used for the purpose of the present invention is between a tenth of several nanometers and hundreds of several nanometers and preferably between a nanometer and twenty nanometers.

Since the term "fine particle" is frequently used herein, it will be described in greater depth below.

A small particle is referred to as a "fine particle" and a particle smaller than a fine particle is referred to as an "ultrafine particle". A particle smaller than an "ultrafine particle" and constituted by several hundred atoms is often referred to as a "cluster".

However, these definitions are not rigorous and the scope of each term can vary depending on the particular aspect of the particle to be dealt with. An "ultrafine particle" may be referred to simply as a "fine particle" as in the case of this patent application. "The Experimental Physics Course No. 14: Surface/Fine Particle" (ed., Koreo Kinoshita; Kyoritu Publication, Sep. 1, 1986) describes as follows. "A fine particle as used herein refers to a particle having a diameter somewhere between 2 to 3 $\mu$m and 10 nm and an ultrafine particle as used herein means a particle having a diameter somewhere between 10 nm and 2 to 3 nm. However, these definitions are by no means rigorous and an ultrafine particle may also be referred to simply as a fine particle. Therefore, these definitions are a rule of thumb in any means. A particle constituted of two to several hundred atoms is called a cluster." (Ibid., p.195, 11.22–26)

Additionally, "Hayashi's Ultrafine Particle Project" of the New Technology Development Corporation defines an "ultrafine particle" as follows, employing a smaller lower limit for the particle size. "The Ultrafine Particle Project (1981–1986) under the Creative Science and Technology Promoting Scheme defines an ultrafine particle as a particle having a diameter between about 1 and 100 nm. This means an ultrafine particle is an agglomerate of about 100 to $10^8$ atoms. From the viewpoint of atom, an ultrafine particle is a huge or ultrahuge particle." (Ultrafine Particle—Creative Science and Technology: ed., Chikara Hayashi, Ryoji Ueda, Akira Tazaki; Mita Publication, 1988, p.2, 11.1–4) "A particle smaller than an ultrafine particle and constituted by several to several hundred atoms is referred to as a cluster." (Ibid., p.2, 11.12–13)

Taking the above general definitions into consideration, the term "a fine particle" as used herein refers to an agglomerate of a large number of atoms and/or molecules having a diameter with a lower limit between 0.1 nm and lnm and an upper limit of several micrometers.

The electron-emitting region 2 is formed in part of the electroconductive thin film 3 and comprises an electrically highly resistive fissure, although its performance is dependent on the thickness, condition and material of the electroconductive thin film 3 and the energization forming process which will be described hereinafter. The fissure has a uniform width which is not greater than 50 nm. The width of the fissure is determined by observing it through an electron microscope at regularly selected measurement points with 1 $\mu$m intervals over the entire length of the electron-emitting region. When the observed width of the fissure is found with a deviation not exceeding a 20% range on either side from the median over no less than 70% of the entire length, the fissure is expressed to have "a uniform fissure width". When the term "fissure width" is used, it generally refers to the median of the observed values. Note that carbon and/or one or more than one carbon compounds or metal and/or one or more than one metal compounds are found in the electron-emitting region 2 and its vicinity of the electroconductive thin film 3 of an electron-emitting device according to the invention. Also note that the location of the electron-emitting region 2 is not limited to that shown in FIGS. 1A and 1B.

The term "voltage applicable length" refers to the length of a zone along which the device voltage can be applied in the electron-emitting region of an electron-emitting device. Most of the device voltage applied to the device electrodes is applied to that zone of the electron-emitting region to give rise to a fall of voltage.

The voltage applicable length is determined in a manner as described below. An electron-emitting device according to the invention is placed in position onion electron microscope in such a way that the device voltage may be applied to the device electrodes. The electron microscope is provided with an oil-free ultra-high vacuum pump to realize an ultra-high vacuum condition, or a pressure lower than $10^{-4}$ Pa. Electrons emitted from an electron gun of the electron microscope are accelerated and collide with the electron-emitting region of the electron-emitting device to generate secondary electrons, which are observed as secondary electron images that may vary as a function of the electric potential of the electron-emitting region. On the lower potential side of the device electrode and the electroconductive thin film, the generated secondary electrons strike the secondary electron detector of the electron microscope and are observed as a white secondary electron image. On the higher potential side of the device electrode and the electroconductive thin film, on the other hand, only very few electrons strikes the secondary electron detector because of the electric field produced near the electron-emitting region and are collectively observed as a black image. The potential can be determined by using this principle and observing secondary electron images.

Figure 22C:
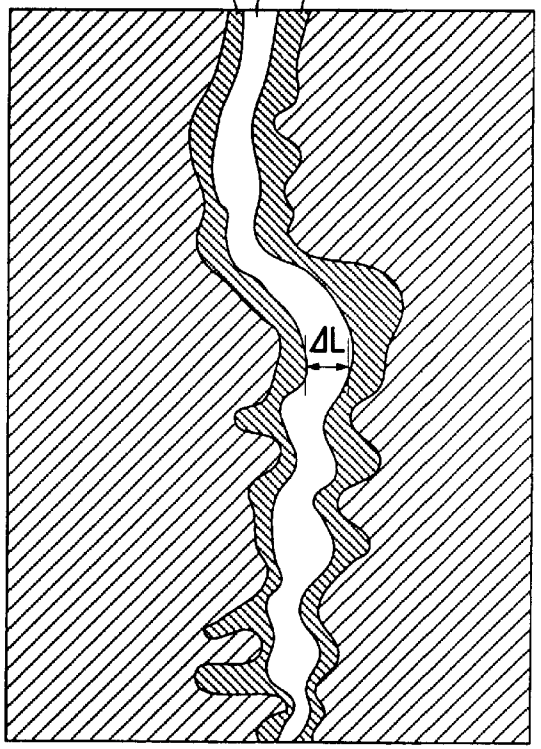
FIGS. 22A through 22C show schematic illustrations of views observed through an electron microscope for determining the voltage applicable length of the electron-emitting region of an electron-emitting device according to the invention.
Figure 22B:
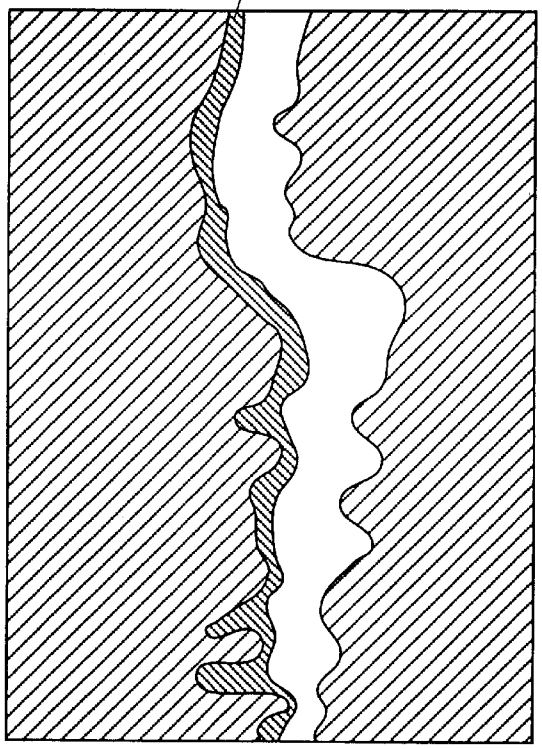
Figure 22A:
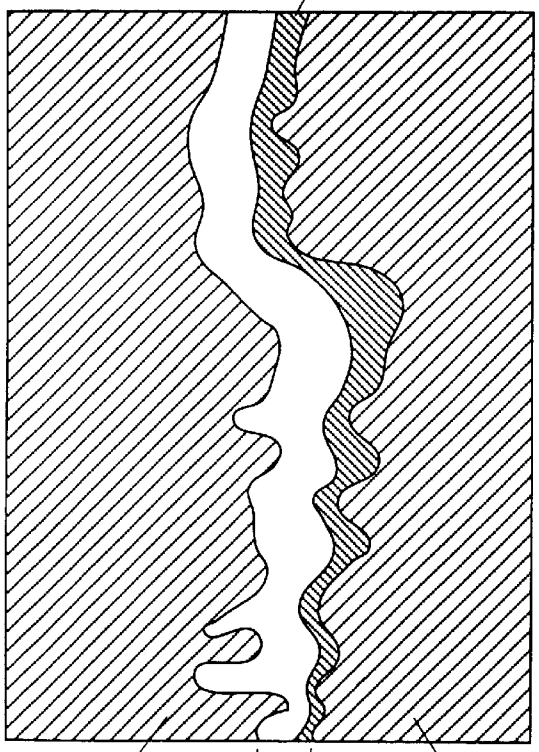

FIG. 22A is a schematic illustration of a view of secondary electron images observed through an electron microscope when a voltage was applied to a specimen of surface conduction electron-emitting device according to the invention. The voltage applied to the device is low and any possible emission of electrons from the device is negligible. More specifically, it is lower than the threshold voltage of Vth shown in FIG. 6 and typically between 1 and 4.0V. When the voltage exceeds this level, electrons emitted from the electron-emitting region can strike the secondary electron detectors so that the potential of the electron-emitting region cannot be correctly observed. In FIG. 22A, the left side is the lower potential side, whereas the right side is the higher potential side of the specimen of surface conduction electron-emitting device. Secondary electrons are observed as a white image on the lower potential side of the electron-emitting region 2, whereas they are observed as a black image on the higher potential side. Although the zone to which the voltage is applied can be defined by observing the gray scale readings of these secondary electron images, it can be more easily defined by taking a pictures of the images, another picture of the images after reversing the voltage applied to the electron-emitting region and laying the developed pictures one on the other. FIG. 22B is a picture of the same area of the device of FIG. 22A after reversing the voltage applied thereto. FIG. 22C is an image obtained by laying the two pictures one on the other. In FIG. 22C, the white zone disposed between two black secondary electron images represents the zone to which the device voltage is effectively applied. The real length ΔL of the zone can be determined by measuring the apparent length on the microscope and using its magnitude over the entire length of the electron-emitting region. As in the case of the fissure width, when the observed voltage applicable length is found with a deviation not exceeding a 20% range on either side from the median over no less than 70% of the entire instances of measurement, the voltage applicable length is expressed to be "uniform". When the term "voltage applicable length" is used, it generally refers to the median of the observed values.

If the black images of the secondary electrons are discontinued by chance, the voltage applicable length was determined without measuring the lengths of any discontinued areas.

Although not used in the examples and comparative examples that will be described hereinafter, a scanning tunneling microscope (STM) may be used in place of the electron microscope for the above measurement operations. With an STM, a voltage of 1 to 2.5V is applied to the electron-emitting device, scanning the device from the lower potential side to the higher potential side by means of an STM probe. Of all the instances of measurement, the ΔL is determined for the areas where a value between 30 and 70% of the applied voltage is observed and the obtained values are used to determine the median of voltage applicable length.

When the electron-emitting region and its vicinity is observed with a scanning electron microscope, a deposit of carbon, one or more than one carbon compounds, metal and/or one or more than one metal compounds will be found not only on the electron-emitting region but also on the higher potential side of the electroconductive thin film. Such a deposit seem as if it were discharged from some portions of the electron-emitting region. This may suggest that the deposit is formed under the effect of electrons emitted from the portions. In other words, by observing the deposit, it will be found that if electrons have been emitted from the entire electron-emitting region or only from part of the electron-emitting region.

Figure 2:
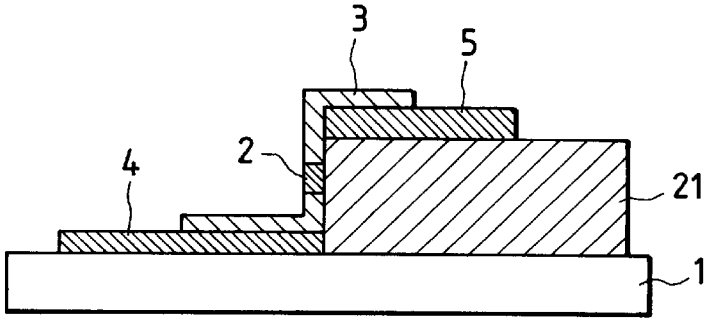
FIG. 2 is a schematic cross sectional view of a step type surface conduction electron-emitting device according to the invention.

FIG. 2 is a schematic cross sectional view of a step type semiconductor electron-emitting device according to the invention.

In FIG. 2, the components that are same as or similar to those of the device of FIGS. 1A and 1B are denoted by the same reference symbols. Reference symbol 21 denotes a step-forming section. The device comprises a substrate 1, device electrodes 4 and 5, electroconductive thin film 3 and an electron emitting region 2, which are made of materials same as a flat (plane) type surface conduction electron-emitting device as described above, as well as a step-forming section 21 made of an insulating material such as $SiO_2$ produced by vacuum evaporation, printing or sputtering and having a height corresponding to the distance L separating the device electrodes of a flat type surface conduction electron-emitting device as described above, or between several hundred nanometers and several hundred micrometers. Preferably, the height of the step-forming section 21 is between several micrometers and several hundred micrometers, although it is selected as a function of the method of producing the step-forming section used there and the voltage to be applied to the device electrodes.

After forming the device electrodes 4 and 5 and the step-forming section 21, the electroconductive thin film 3 is laid on the device electrodes 4 and 5. While the electron-emitting region 2 is formed on the step-forming section 21 in FIG. 2, its location and contour are dependent on the conditions under which it is prepared, and the energization forming conditions and other related conditions are not limited to those shown there.

Figure 3A:
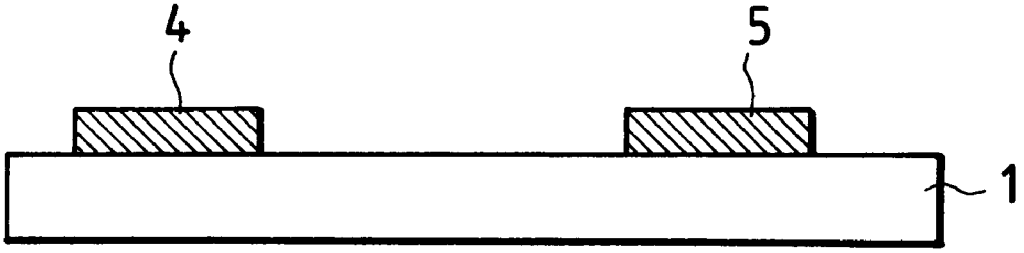
FIGS. 3A through 3C are schematic cross sectional views of the surface conduction electron-emitting device of FIGS. 1A and 1B, showing different manufacturing steps.
Figure 3B:
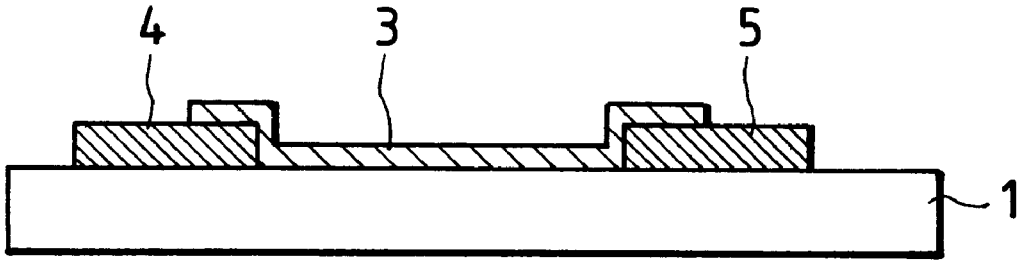
Figure 3C:
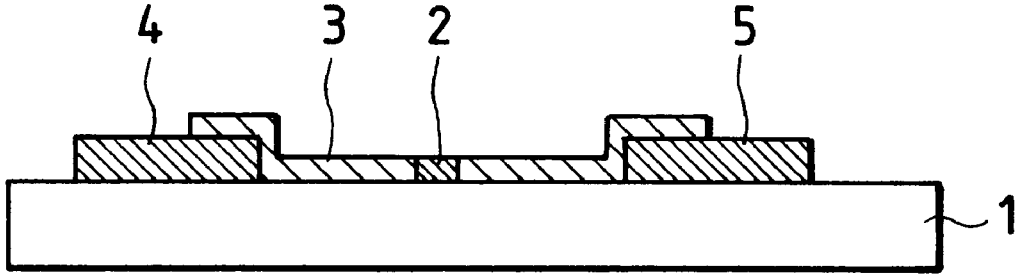

While various methods may be conceivable for manufacturing a surface conduction electron-emitting device according to the invention, FIGS. 3A through 3C schematically illustrate a typical one of such methods.

Now, a method of manufacturing a flat type surface conduction electron-emitting device according to the invention will be described by referring to FIGS. 3A and 3B.

1) After thoroughly cleansing a substrate 1 with detergent and pure water, a material is deposited on the substrate 1 by means of vacuum evaporation, sputtering or some other appropriate technique for a pair of device electrodes 4 and 5, which are then patterned by the photolithography technique (FIG. 3A). If one of the device electrodes 4 and 5, for example the device electrode 5, is made thicker than the other, the device electrode 4 is covered by a mask and the material of the device electrode is further deposited on the device electrode 5 to make the stepped section of the device electrode 5 higher than that of the device electrode 4.

2) An organic metal thin film is formed on the substrate 1 carrying thereon the pair of device electrodes 4 and 5 by applying an organic metal solution. The organic metal solution may contain as a principal ingredient any of the metals listed above for the electroconductive thin film 3. Thereafter, the organic metal thin film is heated, baked and subsequently subjected to a patterning operation, using an appropriate technique such as lift-off or etching, to produce an electroconductive thin film 3 (FIG. 3B). While an organic metal solution is used to produce thin films in the above description, an electroconductive thin film 3 may alternatively be formed by vacuum evaporation, sputtering, chemical vapor deposition, dispersion coating, dipping, spinner coating or some other technique.

3) Thereafter, the device is subjected to a process referred to as energization forming conducted in a gas atmosphere that promotes the cohesion of the electroconductive thin film 3 and produces an electron-emitting region 2 (FIGS. 3A to 3C). As a result of energization forming, part of the electroconductive thin film 3 is locally destructed, deformed or transformed to make an electron-emitting region 2.

The voltage to be used for energization forming preferably has a pulse waveform. A triangular pulse voltage having a constant height or a constant peak voltage may be applied continuously as shown in FIG. 23A or, alternatively, a triangular pulse voltage having an increasing wave height or an increasing peak voltage may be applied as shown in FIG. 23B.

Figure 23A:
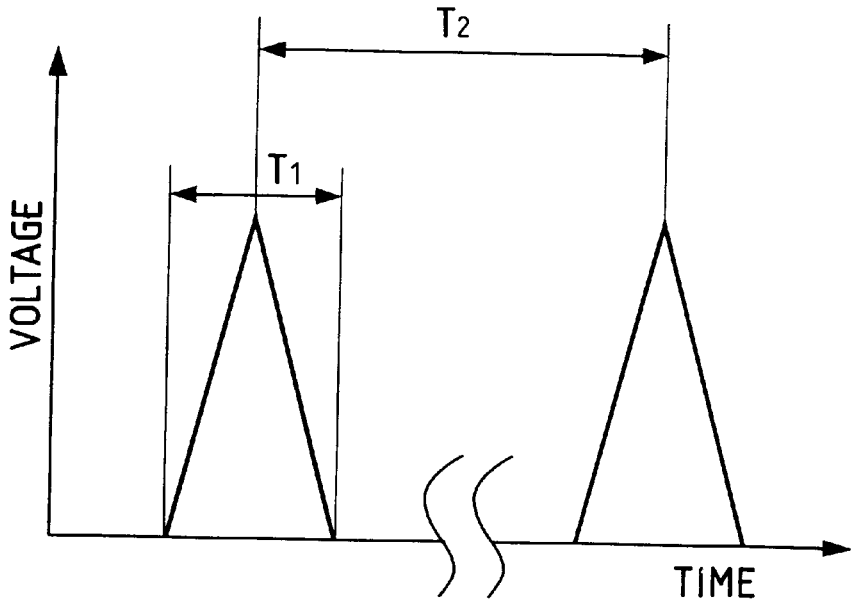
FIGS. 23A and 23B are graphs schematically illustrating the triangular pulse voltages used for energization forming in Example 9.

In FIG. 23A, the pulse voltage has a pulse width T1 and a pulse interval T2, which are typically between 1 $\mu$sec and 10 msec and between 10 $\mu$sec and 100 msec. respectively. The height of the triangular wave (the peak voltage for the energization forming operation) may be appropriately selected depending on the profile of the surface conduction electron-emitting device, and the pulse voltage is applied for a time between several seconds and several minutes.

Figure 23B:
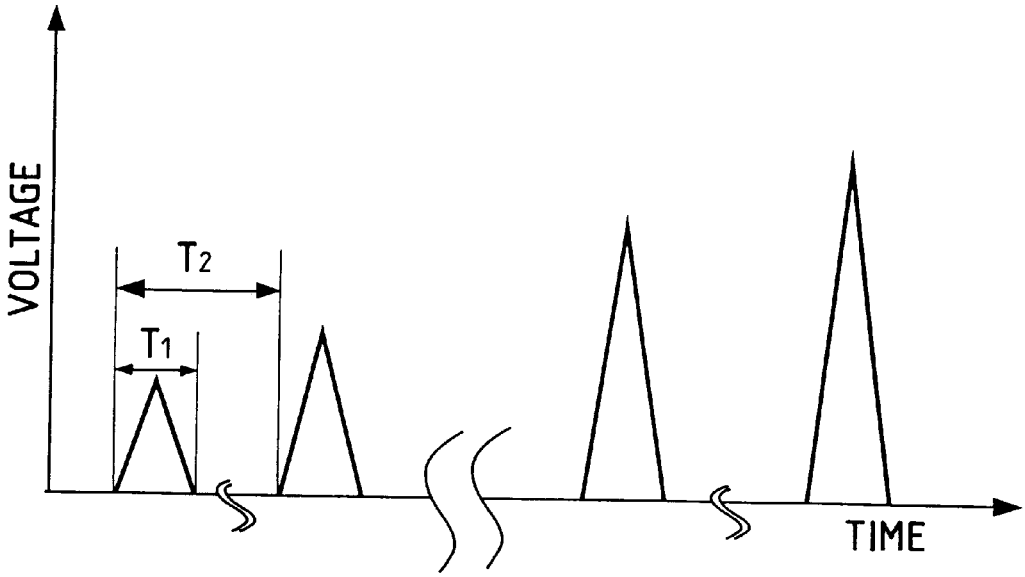

FIG. 23B shows a pulse voltage whose pulse height increases with time. In FIG. 23B, the pulse voltage has an width T1 and a pulse interval T2 that are substantially similar to those of FIG. 23A. The height of the triangular wave (the peak voltage for the energization forming operation) is, however, gradually increased.

The energization forming operation will be terminated by measuring the current running through the device electrodes when a voltage that is sufficiently low and cannot locally destroy or deform the electroconductive thin film 2, or about 0.1V, is applied to the device during an interval T2 of the pulse voltage. Typically the energization forming operation is terminated when a resistance greater than 1M ohms is observed for the device current running through the electroconductive thin film 3 while applying a voltage of approximately 0.1V to the device electrodes.

Reductive substances such as $H_2$ and CO may be used for the gas for promoting the cohesion of the electroconductive thin film 3 when it is made of a metal oxide. Besides $H_2$ and CO, organic substances such as methane, ethane, ethylene, propylene, benzene, toluene, methanol, ethanol, acetone may also be effectively used. These substances seem to trigger the cohesion of the electroconductive thin film when the metal oxide of the electroconductive thin film is reduced to become metal. Therefore, if the electroconductive thin film is made of metal, it is not reduced and hence does not give rise to any cohesion. However, $H_2$ operates well to promote the cohesion, although CO and acetone do not show any such effect.

When the energization forming process is conducted in the above described atmosphere, the power consumption can be reduced by tens of several percents from the level observed when the process is carried out in vacuum.

This may be because, while Joule's heat is generated by the electric current running through the device to raise the temperature of the electroconductive thin film 3 and consequently locally destroy, deform or transform part of the thin film to produce an electron-emitting region 2 there with the conventional energization forming, the local destruction, deformation or transformation of the electroconductive thin film is caused by the substance that promotes the cohesion of the electroconductive thin film to consequently reduce the power consumption.

The gas pressure that can advantageously promote the cohesion of the electroconductive thin film varies as a function of the type of the gas, the material of the electroconductive thin film, the waveform of the applied pulse voltage and other factors. If the pressure is relatively low, the effect of reducing the power consumption first becomes apparent when the energization forming is started by applying a pulse voltage with an increasing pulse height. If the pressure is raised, the gas gives rise to the effect of providing a fissure having a uniform width and an additional effect of preventing a leak current from appearing.

4) Subsequently, the device is preferably subjected to an activation process. An activation process is a process by means of which the device current If and the emission current Ie are changed remarkably.

In an activation process, a pulse voltage may be repeatedly applied to the device in an atmosphere of the gas of an organic substance. The atmosphere may be produced by utilizing the organic gas remaining in a vacuum chamber after evacuating the chamber by means of an oil diffusion pump and a rotary pump or by sufficiently evacuating a vacuum chamber by means of an ion pump and thereafter introducing the gas of an organic substance into the vacuum chamber. The gas pressure of the organic substance is determined as a function of the profile of the electron-emitting device to be treated, the profile of the vacuum chamber, the type of the organic substances and other factors. Organic substances that can be suitably used for the purpose of the activation process include aliphatic hydrocarbons such as alkanes, alkenes and alkynes, aromatic hydrocarbons, alcohols, aldehydes, ketones, amines, organic acids such as phenol, carboxylic acids and sulfonic acids. Specific examples include saturated hydrocarbons expressed by general formula $C_nH_{2n+2}$ such as methane, ethane and propane, unsaturated hydrocarbons expressed by general formula $C_nH_{2n}$ such as ethylene and propylene, benzene, toluene, methanol, ethanol, formaldehyde, acetaldehyde, acetone, methyl ethyl ketone, methylamine, ethylamine, phenol, formic acid, acetic acid and propionic acid. As a result of an activation process, carbon or a carbon compound is deposited on the device out of the organic substances existing in the atmosphere to remarkably change the device current If and the emission current Ie.

When an activation process is conducted on an electron-emitting device in an atmosphere having an appropriate vapor pressure of a metal compound, the metal of the compound can be deposited on the device. Metal compounds that can be used for the purpose of the invention include metal halogenates such as fluorides, chlorides, bromides and iodides, alkyl metals such as methylated, ethylated and benzylated metals, metal-diketonates such as acetylacetonates, dipivanoylmethanates and hexafluoroacetylacetonates, metal enyl complexes such as cyclopentadienyl complexes, metal arene complexes such as metal benzen complexes, metal carbonyls, metal alkoxides and their composite compounds. In view of the fact that a high melting point substance has to be deposited for the purpose of the present invention, examples of preferable compounds include $NbF_5$, $NbCl_5$, $Nb(C_5H_5)(CO)_4$, $Nb(C_5H_5)_2Cl_2$, $OsF_4$, $Os(C_3H_7O_2)_3$, $OS(CO)_5$, $Os_3(CO)_{12}$, $Os(C_5H_5)_2$, $ReF_5$, $ReCl_5$, $Re(CO)_{10}$, $ReCl(CO)_5$, $Re(CH_3)(CO)_5$, $Re(C_5H_5)(CO)_3$, $Ta(C_5H_5)(CO)_4$, $Ta(OC_2H_5)_5$, $Ta(C_5H_5)_2Cl_2$, $Ta(C_5H_5)_2H_3$, $WF_6$, $W(CO)_6$, $W(C_5H_5)_2Cl_2$, $W(C_5H_5)_2H_2$ and $W(CH_3)_6$. Under certain conditions, the deposited film may contain carbon and other substances in addition to the metal.

The time of terminating the activation process is determined appropriately by observing the device current If and the emission current Ie. The pulse width, the pulse interval and the pulse wave height of the pulse voltage to be used for the activation process will be appropriately selected.

For the purpose of the invention, carbon and carbon compounds include graphite (namely HOPG, PG and GC, of which HOPG has a substantially perfect graphite crystalline structure and PG has a somewhat distorted crystalline structure with an average crystal grain size of 200 angstroms, while the crystalline structure of GC is further distorted with an average crystal grain size as small as 20 angstroms) and noncrystalline carbon (refers to amorphous carbon and a mixture of amorphous carbon and fine crystal grains of graphite) and the thickness of the deposited film is preferably less than 50 nanometers, more preferably less than 30 nm.

5) An electron-emitting device that has been treated in an energization forming process and an activation process is then preferably subjected to a stabilization process. This is a process for removing any organic substances remaining in the vacuum chamber. The pressure in the vacuum chamber needs to be made as low as possible and it is preferably lower than $1.3\times10^{-5}$ Pa and more preferably lower than $1.3\times10^{-6}$ Pa. The vacuuming and exhausting equipment to be used for this process preferably does not involve the use of oil so that it may not produce any evaporated oil that can adversely affect the performance of the treated device during the process. Thus, the use of a sorption pump and an ion pump may be a preferable choice. For evacuating the vacuum chamber, the entire chamber is preferably heated to make it easy to remove the molecules of the organic substances adsorbed by the inner wall of the vacuum chamber and the electron-emitting device.

After the stabilization process, the atmosphere for driving the electron-emitting device is preferably same as the one when the stabilization process is completed, although a higher pressure may alternatively be used without damaging the stability of operation of the electron-emitting device or the electron source if the organic substances or metal coompounds in the chamber are sufficiently removed.

By using such a low pressure atmosphere, the formation of any additional deposit of carbon, a carbon compound, metal or a metal compound can be effectively suppressed to consequently stabilize the device current If and the emission current Ie.

An electron-emitting device according to the invention may be prepared in a different way as will be described below.

Steps 1) and 2) described above will be followed.

3) Subsequently, the device is subjected to an energization forming process, in which a voltage is applied to the device electrodes 4 and 5 to modify the structure of part of the electroconductive thin film 3 and produce an electron-emitting region 2 (FIG. 3C).

Figure 4A:
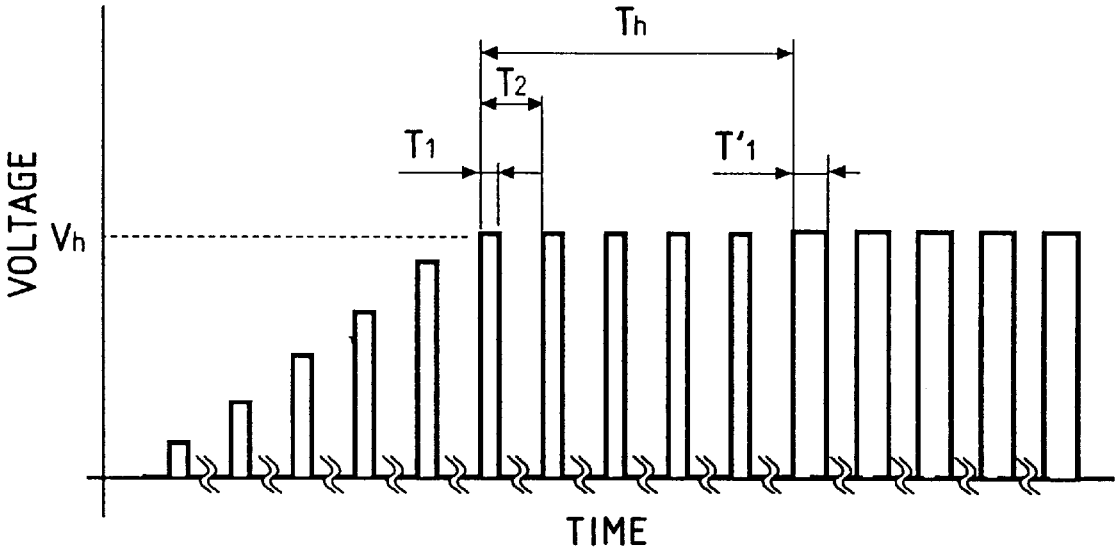
FIGS. 4A and 4B are graphs showing voltage waveforms that can be used for energization forming for the purpose of the present invention.
Figure 4B:
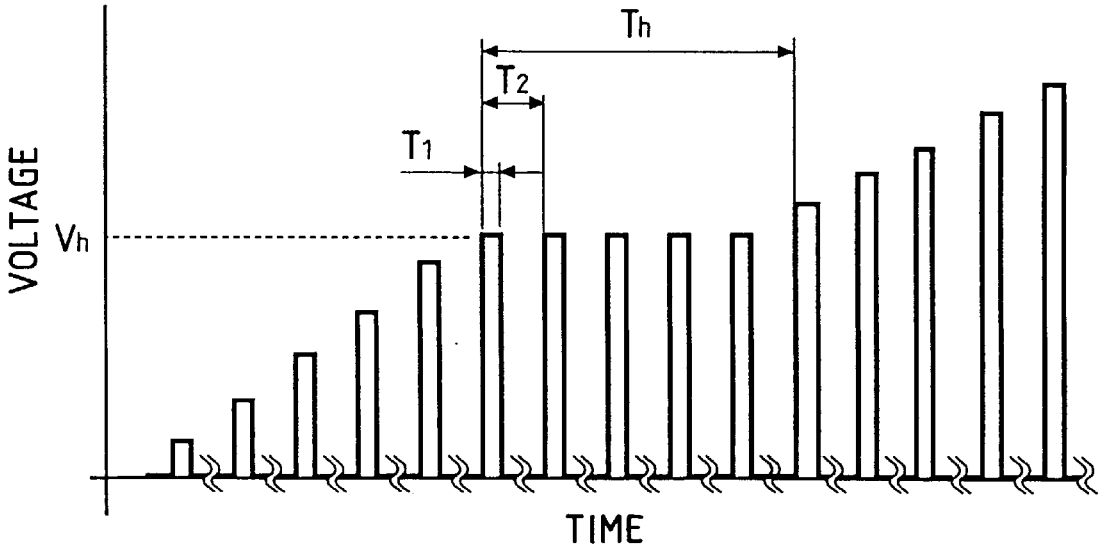

FIGS. 4A and 4B show voltage waveforms that can be used for energization forming for the purpose of the invention.

The wave height (peak value) of the pulse voltage is, for example, increased at a rate of, for instance, 0.1V per step until it gets to Vh, when the electroconductive thin film 3 reduces its resistance or starts cohering. Thereafter, the wave height of Vh is maintained for a predetermined period of time Th, which may be several seconds to tens of several minutes. If Vh has been accurately determined, the wave height of the pulse voltage may be set to Vh from the very beginning and maintained to that level for a predetermined period of time.

A region of discontinued film of fine particles is produced from part of the electroconductive thin film when the applied voltage is held to Vh for a predetermined period of time of Th because the substance of the electroconductive thin film is made to gradually cohere by the applied voltage. During this period, the resistance between the device electrodes 4, 5 including the electroconductive thin film 3 rises until a sufficiently high level, when the energization forming process is terminated. If the resistance does not rise sufficiently during the period Th, the pulse width of the voltage being applied to the device may be increased to raise the resistance of the device before terminating the energization forming (FIG. 4A). Otherwise, the wave height of the pulse voltage may be raised further to raise the resistance of the device before terminating the energization forming (FIG. 4B). Alternatively, the technique of increasing the pulse width and that of increasing the wave height may be used at the same time.

As a result of this energization forming process, a fissure with a width not greater than 50 nm is formed in part of the electroconductive thin film 3 to produce an electron-emitting region 2.

The pulse width Ti is typically between 1 μsec and 10 μmsec and the pulse width T2 is typically between 100 μsec and several seconds, while T1' is typically between 10 μsec and 1 sec and Vh is appropriately determined as a function of the material and contour of the electroconductive thin film 3 and the values of T1 and T2, although they are held to respective values that are several times of one-tenth of a percent to tens of several percents lower than the corresponding values selected for the forming voltage $V_{form}$ of a conventional energization forming process that is monotonically increased to bring forth an abrupt rise of the resistance of the device. A sufficiently large value has to be selected for the pulse interval T2 relative to the pulse width T1 so that their ratio may satisfy expression $T2/T1 \geqq 5$, preferably $T2/T1 \geqq 10$ and more preferably $T2/T1 \geqq 100$. Note that, for the purpose of the invention, a triangular waveform may be used in place of the illustrated rectangular waveform, although care should be taken for the selection of a value for Vh because it is affected not only by the values of T1 and T2 but also by the waveform of the applied pulse voltage.

The above described energization forming process may be conducted in an atmosphere containing gas that promotes the cohesion of the electroconductive thin film.

When the electroconductive thin film is made of a metal oxide that can be reduced with relative ease, the use of gas is expected to show an effect of suppressing variances in the electron-emitting performance of the device if such variances are caused by variances in the resistance of the electroconductive thin film. More specifically, when an electric current is made to flow through an electroconductive thin film made of a metal oxide in the above gas atmosphere, the metal oxide is apt to be reduced by the heat generated by the electric current to reduce the resistance of the electroconductive thin film. Since the wave height of the pulse voltage applied to the device is held to a constant level, the electric current running through the electroconductive thin film is increased, and the rate of heat generation is also increased. The amount of the heat generated at the time of producing the electron-emitting region is believed to be substantially constant regardless of the initial resistance of the electroconductive thin film of the devices to be treated. Therefore, the electron-emitting region is formed when the resistance of the electroconductive thin film is lowered to a given level if the pulse voltage is applied under same conditions. In other words, any devices are processed to produce an electron-emitting region under same conditions to consequently suppress variances in the electron-emitting performance.

Then, activation and stabilization steps follows as in the case of steps 4) and 5) described above.

Figure 5:
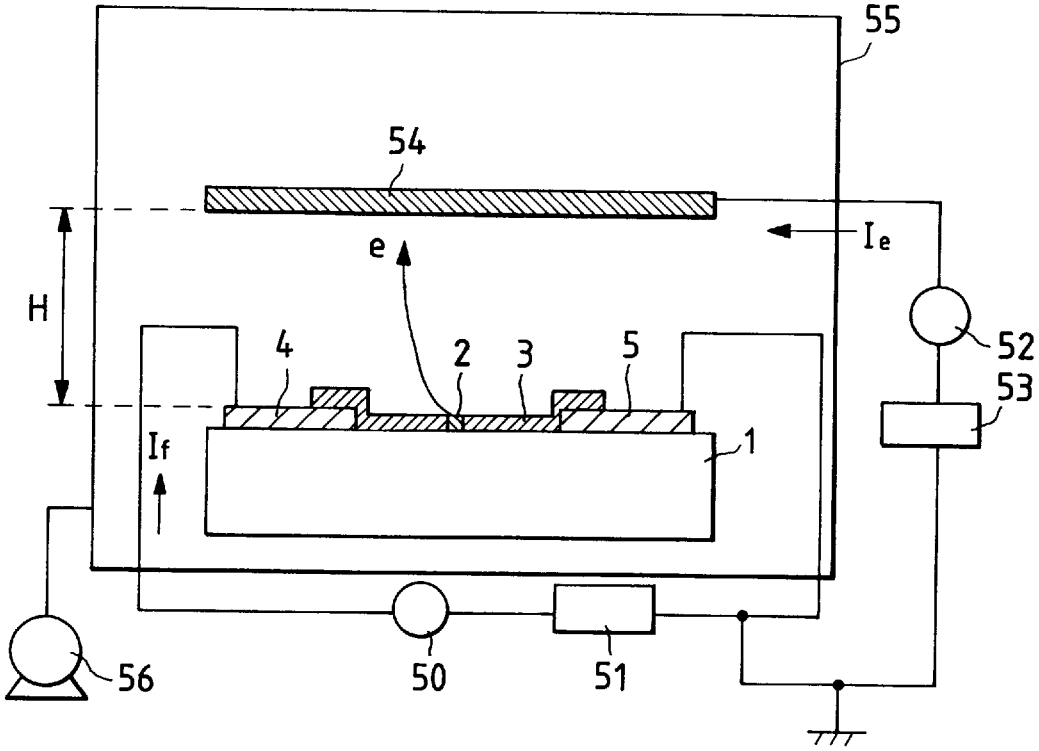
FIG. 5 is a schematic diagram of a gauging system for determining the electron-emitting performance of a electron-emitting device for the purpose of the present invention.

FIG. 5 is a schematic block diagram of an arrangement comprising a vacuum chamber that can be used as a gauging system for determining the performance of an electron-emitting device of the type under consideration.

Referring to FIG. 5, those components that are similar to or same as those of FIGS. 1A and 1B are denoted by the same reference symbols. The gauging system includes a vacuum chamber 55 and a vacuum pump 56. An electron-emitting device is placed in the vacuum chamber 55. The device comprises a substrate 1, a pair of device electrodes 4 and 5, an electroconductive thin film 3 and an electron-emitting region 2. Otherwise, the gauging system has a power source 51 for applying a device voltage Vf to the device, and an ammeter 50 for metering the device current If running through the thin film 3 between the device electrodes 4 and 5, an anode 54 for capturing the emission current Ie produced by electrons emitted from the electron-emitting region of the device, a high voltage source 53 for applying a voltage to the anode 54 of the gauging system and another ammeter 52 for metering the emission current Ie produced by electrons emitted from the electron-emitting region 2 of the device. For determining the performance of the electron-emitting device, a voltage between 1 and 10 KV may be applied to the anode, which is spaced apart from the electron emitting device by distance H which is between 2 and 8 mm.

The surface conduction electron-emitting device and the anode 54 and other components are arranged in the vacuum chamber 55, which is equipped with a vacuum gauge (not shown) and other necessary instruments so that the performance of the electron-emitting device in the chamber may be properly tested in vacuum of a desired degree.

The vacuum pump 56 may be provided with an ordinary high vacuum system comprising a turbo pump or a rotary pump and an ultra-high vacuum system comprising an ion pump which can be used switchably as desired. The entire vacuum chamber 55 and the substrate of an electron-emitting device contained therein can be heated by means of a heater (not shown). Thus, this vacuum processing arrangement can be used for an energization forming process and the subsequent processes.

Figure 6:
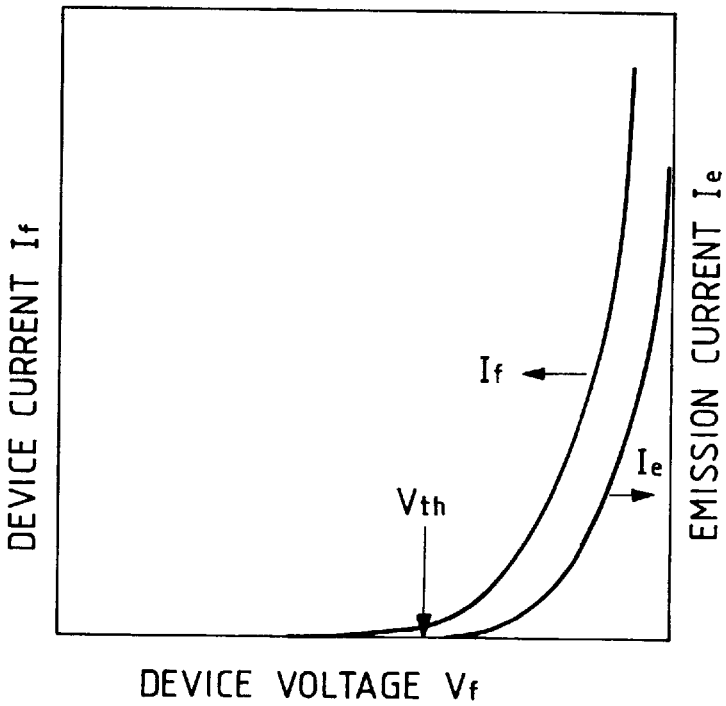
FIG. 6 is a graph showing a typical relationship between the emission current Ie and the device voltage Vf and between the device current If and the device voltage Vf.

FIG. 6 shows a graph schematically illustrating the relationship between the device voltage Vf and the emission current Ie and the device current If typically observed by the gauging system of FIG. 5. Note that different units are arbitrarily selected for Ie and If in FIG. 6 in view of the fact that Ie has a magnitude by far smaller than that of If. Note that both the vertical and transversal axes of the graph represent a linear scale.

As seen in FIG. 6, an electron-emitting device according to the invention has three remarkable features in terms of emission current Ie, which will be described below.

(i) Firstly, an electron-emitting device according to the invention shows a sudden and sharp increase in the emission current Ie when the voltage applied thereto exceeds a certain level (which is referred to as a threshold voltage hereinafter and indicated by Vth in FIG. 6), whereas the emission current Ie is practically undetectable when the applied voltage is found lower than the threshold value Vth. Differently stated, an electron-emitting device according to the invention is a non-linear device having a clear threshold voltage Vth to the emission current Ie.

(ii) Secondly, since the emission current Ie is increases monotonically as highly dependent on the device voltage Vf, the former can be effectively controlled by way of the latter.

(iii) Thirdly, the emitted electric charge captured by the anode 54 (FIG. 5) is a function of the duration of time of application of the device voltage Vf. In other words, the amount of electric charge captured by the anode 54 can be effectively controlled by way of the time during which the device voltage Vf is applied.

Because of the above remarkable features, it will be understood that the electron-emitting behavior of an electron source comprising a plurality of electron-emitting devices according to the invention and hence that of an image-forming apparatus incorporating such an electron source can easily be controlled in response to the input signal. Thus, such an electron source and an image-forming apparatus may find a variety of applications.

On the other hand, the device current If either monotonically increases relative to the device voltage Vf (as shown in FIG. 6, a characteristic referred to as "MI characteristic" hereinafter) or changes to show a curve (not shown) specific to a voltage-controlled-negative-resistance characteristic (a characteristic referred to as "VCNR characteristic" hereinafter, although it is not illustrated). These characteristics of the device current are dependent on a number of factors including the manufacturing method, the conditions where it is gauged and the environment for operating the device.

Now, some examples of the usage of electron-emitting devices, to which the present invention is applicable, will be described. According to the invention, an electron source and hence an image-forming apparatus comprising such an electron source can be realized by arranging a plurality of electron-emitting devices according to the above described aspect of the present invention.

Electron-emitting devices may be arranged on a substrate in a number of different modes.

For instance, a number of electron-emitting devices may be arranged in parallel rows along a direction (hereinafter referred to row-direction), each device being connected by wires as at opposite ends thereof, and driven to operate by control electrodes (hereinafter referred to as grids) arranged in a space above the electron-emitting devices along a direction perpendicular to the row direction (hereinafter referred to as column-direction) to realize a ladder-like arrangement. Alternatively, a plurality of electron-emitting devices may be arranged in rows along an X-direction and columns along a Y-direction to form a matrix, the X- and Y-directions being perpendicular to each other, and the electron-emitting devices on a same row are connected to a common X-directional wire by way of one of the electrodes of each device while the electron-emitting devices on a same column are connected to a common Y-directional wire by way of the other electrode of each device. The latter arrangement is referred to as a simple matrix arrangement. Now, the simple matrix arrangement will be described in detail.

In view of the above described three basic characteristic features (i) through (iii) of a surface conduction electron-emitting device, to which the invention is applicable, it can be controlled for electron emission by controlling the wave height and the wave width of the pulse voltage applied to the opposite electrodes of the device above the threshold voltage level. On the other hand, the device does not practically emit any electron below the threshold voltage level. Therefore, regardless of the number of electron-emitting devices arranged in an apparatus, desired surface conduction electron-emitting devices can be selected and controlled for electron emission in response to an input signal by applying a pulse voltage to each of the selected devices.

Figure 7:
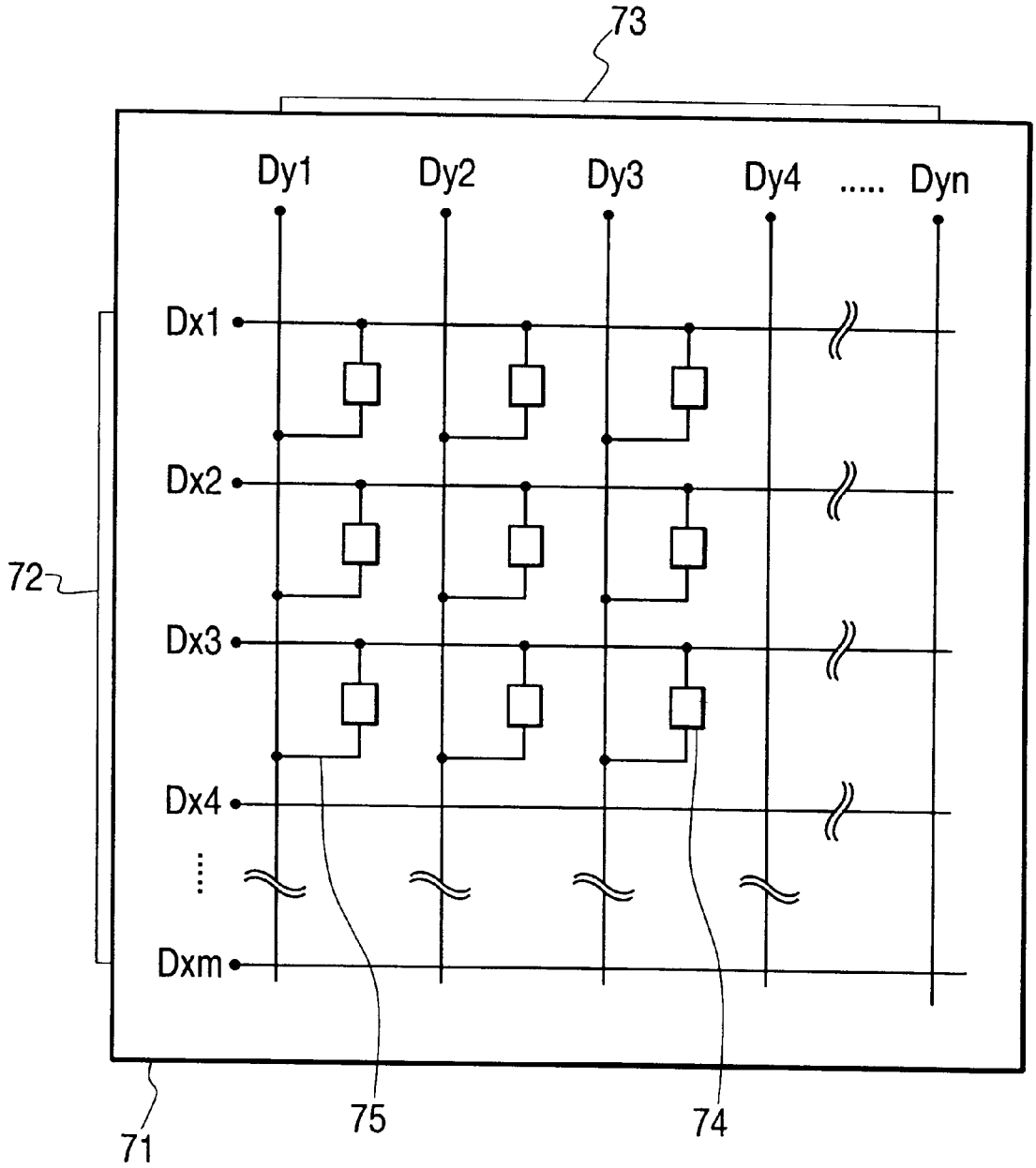
FIG. 7 is a schematic plan view of an electron source having a simple matrix arrangement.

FIG. 7 is a schematic plan view of the substrate of an electron source realized by arranging a plurality of electron-emitting devices, to which the present invention is applicable, in order to exploit the above characteristic features. In FIG. 7, the electron source comprises an electron source substrate 71, X-directional wires 72, Y-directional wires 73, surface conduction electron-emitting devices 74 and connecting wires 75. The surface conduction electron-emitting devices may be either of the flat type or of the step type described earlier.

There are provided a total of m X-directional wires 72, which are donated by Dx1, Dx2, . . . , Dxm and made of an electroconductive metal produced by vacuum evaporation, printing or sputtering. These wires are appropriately designed in terms of material, thickness and width. A total of n Y-directional wires 73 are arranged and donated by Dy1, Dy2, . . . , Dyn, which are similar to the X-directional wires 72 in terms of material, thickness and width. An interlayer insulation layer (not shown) is disposed between the m X-directional wires 72 and the n Y-directional wires 73 to electrically isolate them from each other. (Both m and n are integers.) The interlayer insulation layer (not shown) is typically made of $SiO_2$ and formed on the entire surface or part of the surface of the insulating substrate 71 to show a desired contour by means of vacuum evaporation, printing or sputtering. For example, it may be formed on the entire surface or part of the surface of the substrate 71 on which the X-directional wires 72 have been formed. The thickness, material and manufacturing method of the interlayer insulation layer are so selected as to make it withstand the potential difference between any of the X-directional wires 72 and any of the Y-directional wire 73 observable at the crossing thereof. Each of the X-directional wires 72 and the Y-directional wires 73 is drawn out to form an external terminal.

The oppositely arranged paired electrodes (not shown) of each of the surface conduction electron-emitting devices 74 are connected to related one of the m X-directional wires 72 and related one of the n Y-directional wires 73 by respective connecting wires 75 which are made of an electroconductive metal.

The electroconductive metal material of the wires 72 and 73, the device electrodes and the connecting wires 75 extending from the wires 72 and 73 may be same or contain a common element as an ingredient. Alternatively, they may be different from each other. These materials may be appropriately selected typically from the candidate materials listed above for the device electrodes. If the device electrodes and the connecting wires are made of a same material, they may be collectively called device electrodes without discriminating the connecting wires.

The X-directional wires 72 are electrically connected to a scan signal application means (not shown) for applying a scan signal to a selected row of surface conduction electron-emitting devices 74. On the other hand, the Y-directional wires 73 are electrically connected to a modulation signal generation means (not shown) for applying a modulation signal to a selected column of surface conduction electron-emitting devices 74 and modulating the selected column according to an input signal. Note that the drive signal to be applied to each surface conduction electron-emitting device is expressed as the voltage difference of the scan signal and the modulation signal applied to the device.

With the above arrangement, each of the devices can be selected and driven to operate independently by means of a simple matrix wire arrangement.

Figure 8:
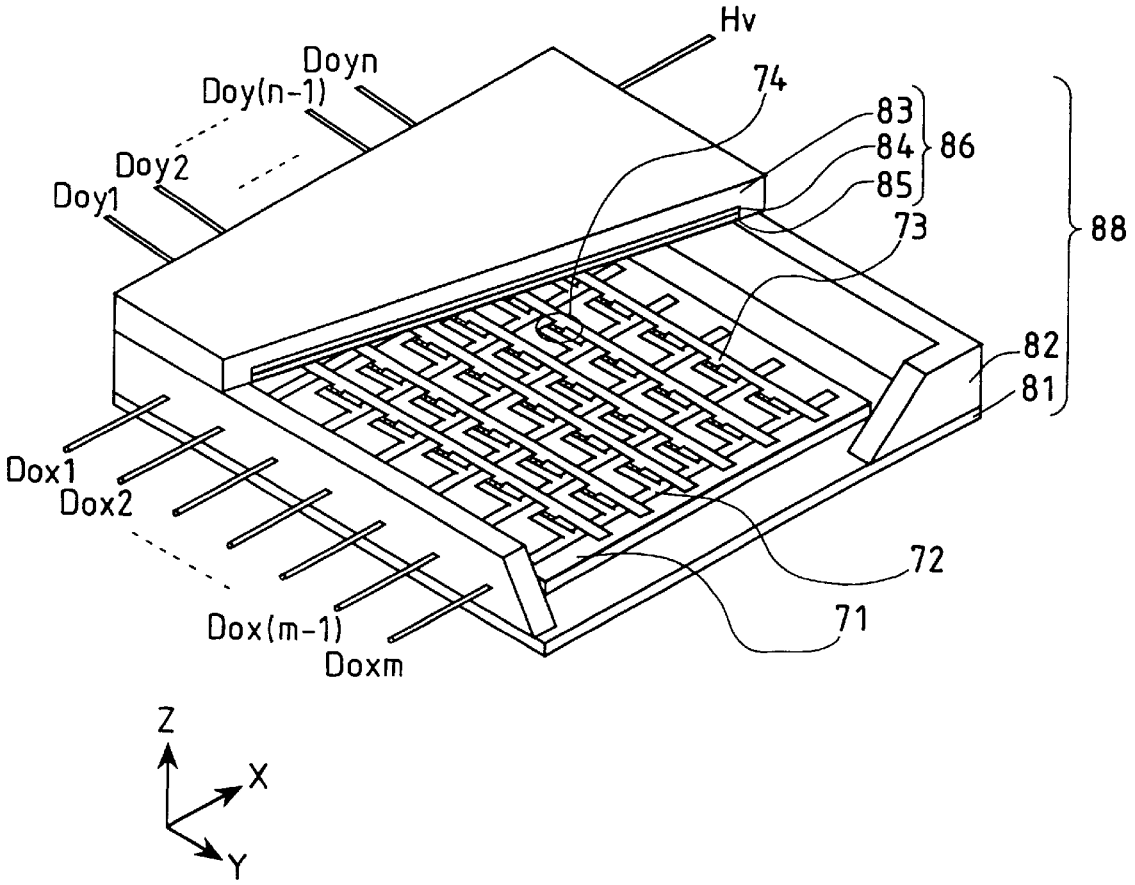
FIG. 8 is a partly cut away schematic perspective view of an image-forming apparatus comprising an electron source having a simple matrix arrangement.
Figure 9A:
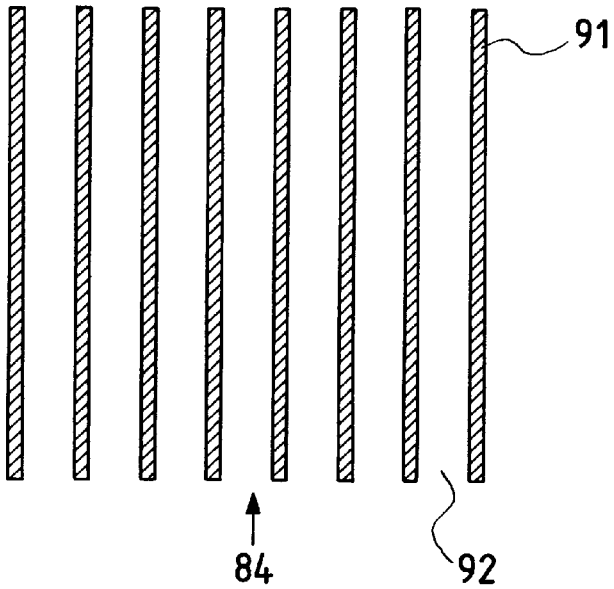
FIGS. 9A and 9B are two possible arrangements of fluorescent members that can be used for the purpose of the present invention.
Figure 9B:
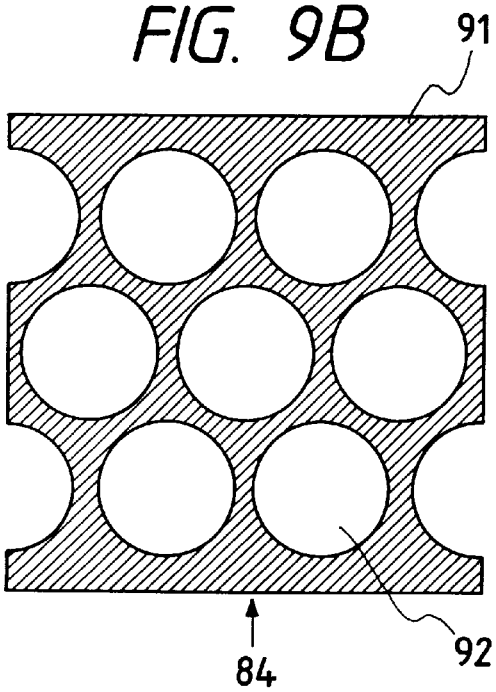
Figure 10:
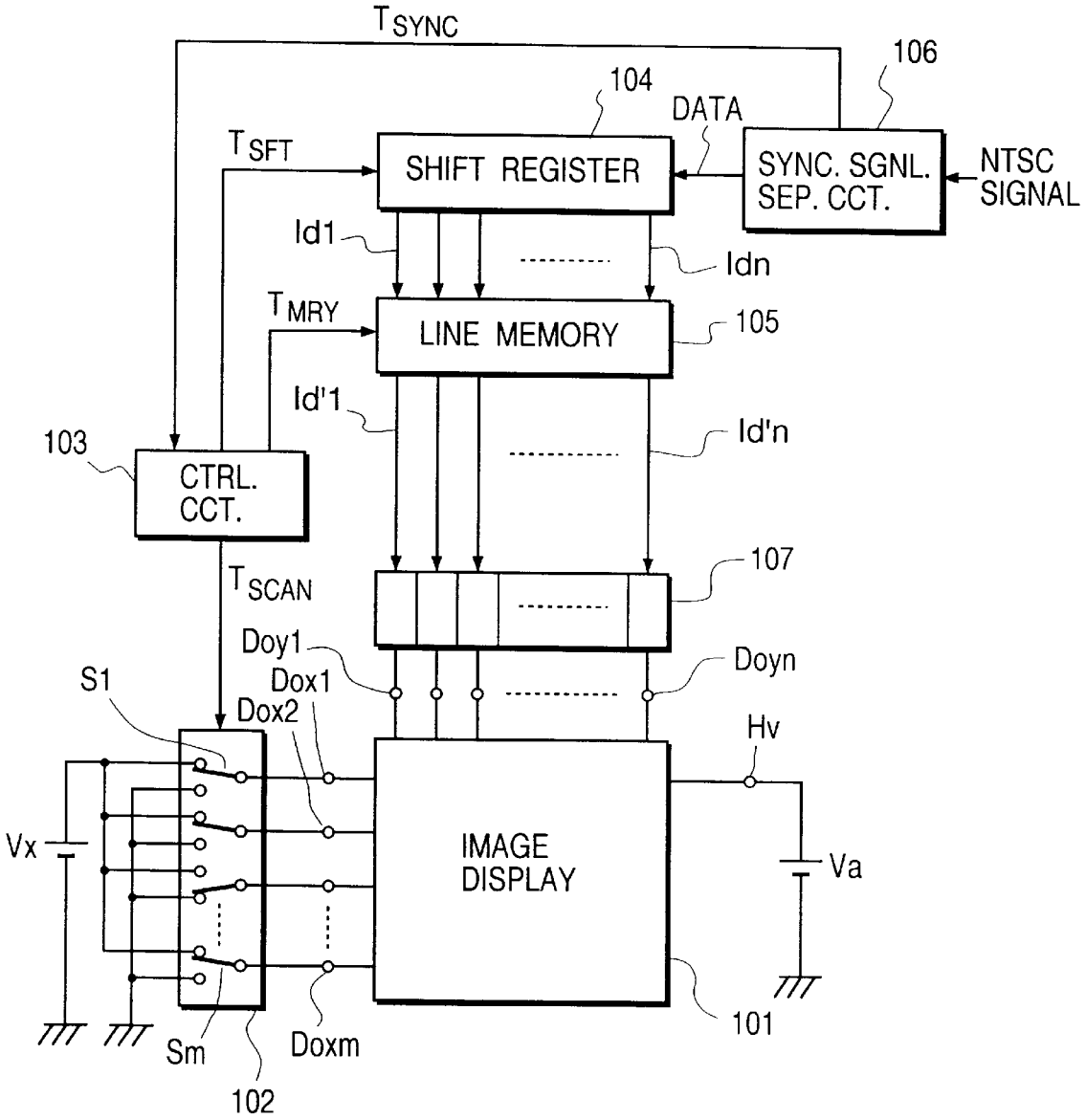
FIG. 10 is a schematic circuit diagram of a drive circuit that can be used for dislaying images according to NTSC television signals as well as a block diagram of an image-forming apparatus having such a drive circuit.

Now, an image-forming apparatus comprising an electron source having a simple matrix arrangement as described above will be described by referring to FIGS. 8, 9A, 9B and 10. FIG. 8 is a partially cut away schematic perspective view of the image forming apparatus and FIGS. 9A and 9B show two possible configurations of a fluorescent film that can be used for the image forming apparatus of FIG. 8, whereas FIG. 10 is a block diagram of a drive circuit for the image forming apparatus of FIG. 8 that operates for NTSC television signals.

Referring firstly to FIG. 8 illustrating the basic configuration of the display panel of the image-forming apparatus, it comprises an electron source substrate 71 of the above described type carrying thereon a plurality of electron-emitting devices, a rear plate 81 rigidly holding the electron source substrate 71, a face plate 86 prepared by laying a fluorescent film 84 and a metal back 85 on the inner surface of a glass substrate 83 and a support frame 82, to which the rear plate 81 and the face plate 86 are bonded by means of frit glass. Reference numeral 88 denotes an envelope, which is baked to 400 to 500° C. for more than 10 minutes in the atmosphere or in nitrogen and hermetically and airtightly sealed.

In FIG. 8, reference numeral 74 denotes the electron-emitting region of each electron-emitting device that corresponds to the electron-emitting region 2 of FIGS. 1A and 1B and reference numerals 72 and 73 respectively denotes the X-directional wire and the Y-directional wire connected to the respective device electrodes of each electron-emitting device.

While the envelope 88 is formed of the face plate 86, the support frame 82 and the rear plate 81 in the above described embodiment, the rear plate 81 may be omitted if the substrate 71 is strong enough by itself because the rear plate 81 is provided mainly for reinforcing the substrate 71. If such is the case, an independent rear plate 81 may not be required and the substrate 71 may be directly bonded to the support frame 82 so that the envelope 88 is constituted of a face plate 86, a support frame 82 and a substrate 71. The overall strength of the envelope 88 may be increased by arranging a number of support members called spacers (not shown) between the face plate 86 and the rear plate 81.

FIGS. 9A and 9B schematically illustrate two possible arrangements of fluorescent film. While the fluorescent film 84 comprises only a single fluorescent body if the display panel is used for showing black and white pictures, it needs to comprise for displaying color pictures black conductive members 91 and fluorescent bodies 92, of which the former are referred to as black stripes or members of a black matrix depending on the arrangement of the fluorescent bodies. Black stripes or members of a black matrix are arranged for a color display panel so that the fluorescent bodies 89 of three different primary colors are made less discriminable and the adverse effect of reducing the contrast of displayed images of external light is weakened by blackening the surrounding areas. While graphite is normally used as a principal ingredient of the black stripes, other conductive material having low light transmissivity and reflectivity may alternatively be used.

A precipitation or printing technique is suitably be used for applying a fluorescent material on the glass substrate 83 regardless of black and white or color display. An ordinary metal back 85 is arranged on the inner surface of the fluorescent film 84. The metal back 85 is provided in order to enhance the luminance of the display panel by causing the rays of light emitted from the fluorescent bodies and directed to the inside of the envelope to turn back toward the face plate 86, to use it as an electrode for applying an accelerating voltage to electron beams and to protect the fluorescent bodies against damages that may be caused when negative ions generated inside the envelope collide with them. It is prepared by smoothing the inner surface of the fluorescent film (in an operation normally called "filming") and forming an Al film thereon by vacuum evaporation after forming the fluorescent film.

A transparent electrode (not shown) may be formed on the face plate 86 facing the outer surface of the fluorescent film 84 in order to raise the conductivity of the fluorescent film 84.

Care should be taken to accurately align each set of color fluorescent bodies and an electron-emitting device, if a color display is involved, before the above listed components of the envelope are bonded together.

After the envelope 88 is bonded together and hermetically sealed, the electron-emitting devices are subjected to an energization forming process. After satisfactorily evacuating the envelope by means of a vacuum apparatus, a desired gas is, if necessary, fed into the envelope and a pulse voltage is applied to all the electron-emitting devices of a selected device row. The values for the pulse width T1, the pulse interval T2 and the wave height are to be selected appropriately as in the case of an energization forming process to be conducted on an individual electron-emitting device. The pulse voltage may be applied to the electron-emitting devices of a selected row and, after completing the energization forming process on the electron-emitting devices of that row, the devices of the selected next row may be subjected to energization forming on a row by row basis. Alternatively, a device row selection means may be arranged between the pulse generator and the electron source so that a plurality of device rows may be simultaneously subjected to an energization forming process by switching from row to row for each pulse. Since the pulse interval T2 is considerably longer than the pulse width T1, the latter technique may be advantageously used to greatly reduce the overall time necessary for the energization forming process. Note that, with the latter technique, all the device rows of the electron source may be treated simultaneously or, alternatively, the device rows may be divided into a number of blocks and the devices of the device rows of each block may be treated simultaneously. Either of the techniques may be appropriately selected depending on the size of the electron source, the shape of the pulse and other factors.

If the electroconductive thin film is made of a metal oxide that can be easily chemically reduced and the energization forming process is conducted in an atmosphere containing a gas that promotes the cohesion of the electroconductive thin film such as $H_2$, the above cited second technique is particularly effective. Namely, in such an atmosphere, the chemical reduction of the metal oxide constituting the electroconductive thin film may proceed very slowly even when an electric current does not flow therethrough to generate heat. If such is the case and the energization forming process is conducted on a row by row basis, the resistance of the electroconductive thin film of the electron-emitting devices belonging to a row that is treated after a preceding row can be reduced remarkably because the chemical reduction proceeds slowly, while the preceding row is receiving an energization forming operation so that the devices may be subjected to differentiated energization forming conditions to consequently make the devices show varied electron-emitting performances.

Contrary to this, the above technique of switching from row to row for every pulse can avoid such a problem because all the device rows are treated substantially simultaneously.

The envelope 88 is evacuated by way of an evacuating system using no oil comprising e.g. an ion pump and a sorption pump and an exhaust pipe (not shown) until the atmosphere in the inside is reduced to a degree of vacuum of $10^{-5}$ Pa containing organic substances to a very low concentration, when it is hermetically sealed, while being heated appropriately as in the case of the above described stabilization process. A getter process may be conducted in order to maintain the achieved degree of vacuum in the inside of the envelope 88 after it is sealed. In a getter process, a getter arranged at a predetermined position (not shown) in the envelope 88 is heated by means of a resistance heater or a high frequency heater to form a film by vapor deposition immediately before or after the envelope 88 is sealed. A getter typically contains Ba as a principal ingredient and can maintain a degree of vacuum between $1.3\times10^{-3}$ Pa and $1.3\times10^{-5}$ Pa by the adsorption effect of the vapor deposition film. The processes of manufacturing surface conduction electron-emitting devices of the image forming apparatus after the forming process may appropriately be designed to meet the specific requirements of the intended application.

Now, a drive circuits for driving a display panel comprising an electron source with a simple matrix arrangement for displaying television images according to NTSC television signals will be described by referring to FIG. 10. In FIG. 10, reference numeral 101 denotes an image-forming apparatus. Otherwise, the circuit comprises a scan circuit 102, a control circuit 103, a shift register 104, a line memory 105, a synchronizing signal separation circuit 106 and a modulation signal generator 107. Vx and Va in FIG. 10 denote DC voltage sources.

The image-forming apparatus 101 is connected to external circuits via terminals Dox1 through Doxm, Doy1 through Doym and high voltage terminal Hv, of which terminals Dox1 through Doxm are designed to receive scan signals for sequentially driving on a one-by-one basis the rows (of N devices) of an electron source in the apparatus comprising a number of surface-conduction type electron-emitting devices arranged in the form of a matrix having M rows and N columns.

On the other hand, terminals Doy1 through Doyn are designed to receive a modulation signal for controlling the output electron beam of each of the surface-conduction type electron-emitting devices of a row selected by a scan signal. High voltage terminal Hv is fed by the DC voltage source Va with a DC voltage of a level typically around 10 kV, which is sufficiently high to energize the fluorescent bodies of the selected surface-conduction type electron-emitting devices.

The scan circuit 102 operates in a manner as follows. The circuit comprises M switching devices (of which only devices S1 and Sm are specifically indicated in FIG. 10), each of which takes either the output voltage of the DC voltage source Vx or 0[V] (the ground potential level) and comes to be connected with one of the terminals Dox1 through Doxm of the display panel 101. Each of the switching devices S1 through Sm operates in accordance with control signal Tscan fed from the control circuit 103 and can be prepared by combining transistors such as FETs.

The DC voltage source Vx of this circuit is designed to output a constant voltage such that any drive voltage applied to devices that are not being scanned is reduced to less than threshold voltage due to the performance of the surface conduction electron-emitting devices (or the threshold voltage for electron emission).

The control circuit 103 coordinates the operations of related components so that images may be appropriately displayed in accordance with externally fed video signals. It generates control signals Tscan, Tsft and Tmry in response to synchronizing signal Tsync fed from the synchronizing signal separation circuit 106, which will be described below.

The synchronizing signal separation circuit 106 separates the synchronizing signal component and the luminance signal component from an externally fed NTSC television signal and can be easily realized using a popularly known frequency separation (filter) circuit. Although a synchronizing signal extracted from a television signal by the synchronizing signal separation circuit 106 is constituted, as well known, of a vertical synchronizing signal and a horizontal synchronizing signal, it is simply designated as Tsync signal here for convenience sake, disregarding its component signals. On the other hand, a luminance signal drawn from a television signal, which is fed to the shift register 104, is designed as DATA signal.

The shift register 104 carries out for each line a serial/parallel conversion on DATA signals that are serially fed on a time series basis in accordance with control signal Tsft fed from the control circuit 103. (In other words, a control signal Tsft operates as a shift clock for the shift register 104.) A set of data for a line that have undergone a serial/parallel conversion (and correspond to a set of drive data for N electron-emitting devices) are sent out of the shift register 104 as N parallel signals Id1 through Idn.

The line memory 105 is a memory for storing a set of data for a line, which are signals Id1 through Idn, for a required period of time according to control signal Tmry coming from the control circuit 103. The stored data are sent out as I'd1 through I'dn and fed to modulation signal generator 107.

Said modulation signal generator 107 is in fact a signal source that appropriately drives and modulates the operation of each of the surface-conduction type electron-emitting devices according to image data I'd1 through I'dn and output signals of this device are fed to the surface-conduction type electron-emitting devices in the display panel 101 via terminals Doy1 through Doyn.

As described above, an electron-emitting device, to which the present invention is applicable, is characterized by the following features in terms of emission current Ie. Firstly, there exists a clear threshold voltage Vth and the device emit electrons only a voltage exceeding Vth is applied thereto. Secondly, the level of emission current Ie changes as a function of the change in the applied voltage above the threshold level Vth. More specifically, when a pulse-shaped voltage is applied to an electron-emitting device according to the invention, practically no emission current is generated so far as the applied voltage remains under the threshold level, whereas an electron beam is emitted once the applied voltage rises above the threshold level. It should be noted here that the intensity of an output electron beam can be controlled by changing the peak level Vm of the pulse-shaped voltage. Additionally, the total amount of electric charge of an electron beam can be controlled by varying the pulse width Pw.

Thus, either voltage modulation method or pulse width modulation method may be used for modulating an electron-emitting device in response to an input signal. With voltage modulation, a voltage modulation type circuit is used for the modulation signal generator 107 so that the peak level of the pulse shaped voltage is modulated according to input data, while the pulse width is held constant.

With pulse width modulation, on the other hand, a pulse width modulation type circuit is used for the modulation signal generator 107 so that the pulse width of the applied voltage may be modulated according to input data, while the peak level of the applied voltage is held constant.

Although it is not particularly mentioned above, the shift register 104 and the line memory 105 may be either of digital or of analog signal type so long as serial/parallel conversions and storage of video signals are conducted at a given rate.

If digital signal type devices are used, output signal DATA of the synchronizing signal separation circuit 106 needs to be digitized. However, such conversion can be easily carried out by arranging an A/D converter at the output of the synchronizing signal separation circuit 106. It may be needless to say that different circuits may be used for the modulation signal generator 107 depending on if output signals of the line memory 105 are digital signals or analog signals. If digital signals are used, a D/A converter circuit of a known type may be used for the modulation signal generator 107 and an amplifier circuit may additionally be used, if necessary. As for pulse width modulation, the modulation signal generator 107 can be realized by using a circuit that combines a high speed oscillator, a counter for counting the number of waves generated by said oscillator and a comparator for comparing the output of the counter and that of the memory. If necessary, an amplifier may be added to amplify the voltage of the output signal of the comparator having a modulated pulse width to the level of the drive voltage of a surface-conduction type electron-emitting device according to the invention.

If, on the other hand, analog signals are used with voltage modulation, an amplifier circuit comprising a known operational amplifier may suitably be used for the modulation signal generator 107 and a level shift circuit may be added thereto if necessary. As for pulse width modulation, a known voltage control type oscillation circuit (VCO) may be used with, if necessary, an additional amplifier to be used for voltage amplification up to the drive voltage of surface-conduction type electron-emitting device.

With an image forming apparatus having a configuration as described above, to which the present invention is applicable, the electron-emitting devices emit electrons as a voltage is applied thereto by way of the external terminals Dox1 through Doxm and Doy1 through Doyn. Then, the generated electron beams are accelerated by applying a high voltage to the metal back 85 or a transparent electrode (not shown) by way of the high voltage terminal Hv. The accelerated electrons eventually collide with the fluorescent film 84, which by turn glows to produce images. The above described configuration of image forming apparatus is only an example to which the present invention is applicable and may be subjected to various modifications. The TV signal system to be used with such an apparatus is not limited to a particular one and any system such as NTSC, PAL or SECAM may feasibly be used with it. It is particularly suited for TV signals involving a larger number of scanning lines (typically of a high definition TV system such as the MUSE system) because it can be used for a large display panel comprising a large number of pixels.

Now, an electron source comprising a plurality of surface conduction electron-emitting devices arranged in a ladder-like manner on a substrate and an image-forming apparatus comprising such an electron source will be described by referring to FIGS. 11 and 12.

Figure 11:
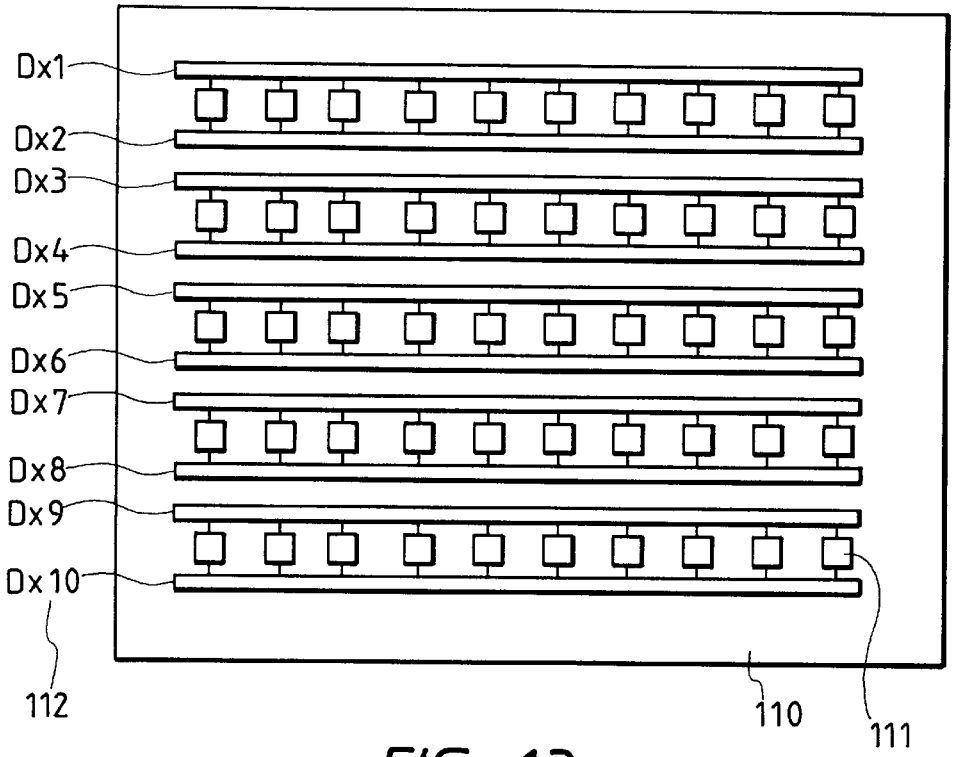
FIG. 11 is a schematic plan view of an electron source having a ladder-like arrangement.

Firstly referring to FIG. 11 schematically showing an electron source having a ladder-like arrangement, reference numeral 110 denotes an electron source substrate and reference numeral 111 denotes an surface conduction electron-emitting device arranged on the substrate, whereas reference numeral 112 denotes (X-directional) wires Dx1 through Dx10 for connecting the surface conduction electron-emitting devices 111. The electron-emitting devices 111 are arranged in rows (to be referred to as device rows hereinafter) on the substrate 110 to form an electron source comprising a plurality of device rows, each row having a plurality of devices in the X-direction. The surface conduction electron-emitting devices of each device row are electrically connected in parallel with each other by a pair of common wires so that they can be driven independently by applying an appropriate drive voltage to the pair of common wires. More specifically, a voltage exceeding the electron emission threshold level is applied to the device rows to be driven to emit electrons, whereas a voltage below the electron emission threshold level is applied to the remaining device rows. Alternatively, any two external terminals arranged between two adjacent device rows can share a single common wire. Thus, for example, of the common wires Dx2 through Dx9, Dx2 and Dx3 can share a single common wire instead of two wires.

Figure 12:
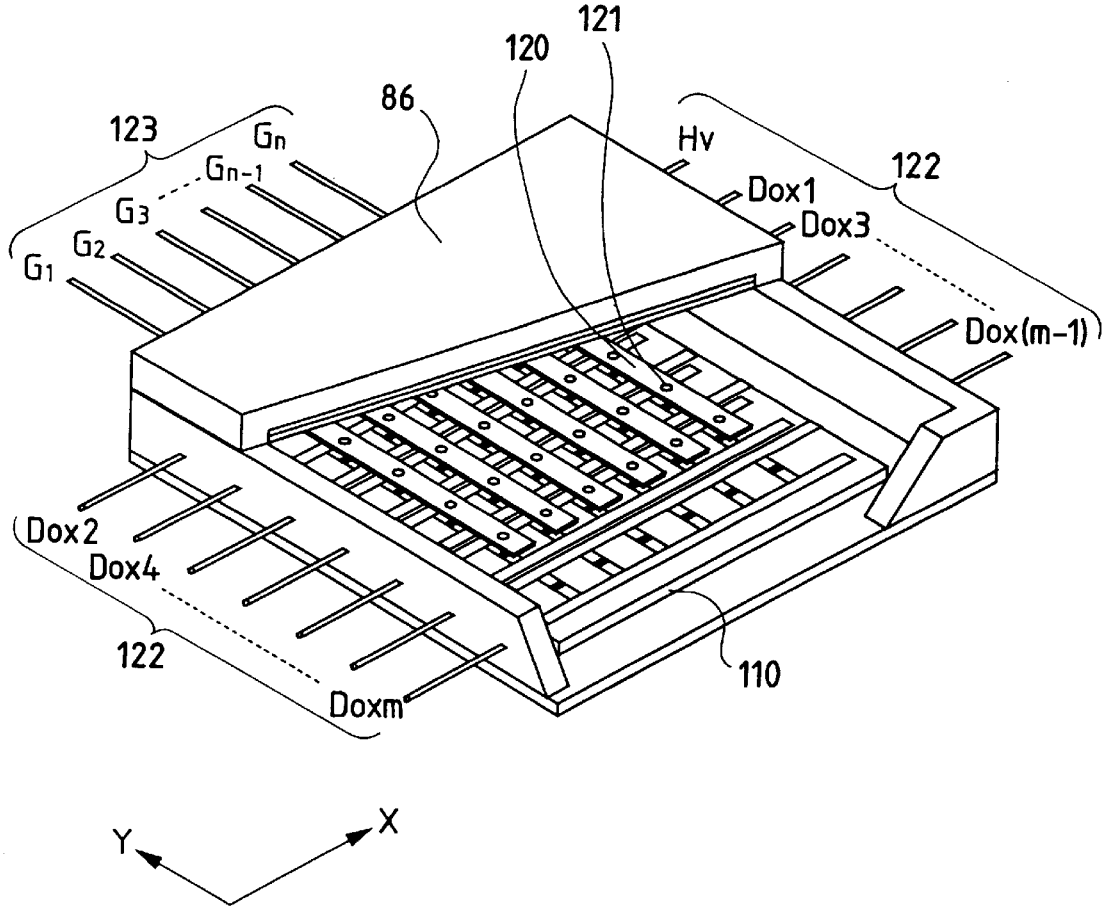
FIG. 12 is a partly cut away schematic perspective view of an image-forming apparatus comprising an electron source having a ladder-like arrangement.

FIG. 12 is a schematic perspective view of the display panel of an image-forming apparatus incorporating an electron source having a ladder-like arrangement of electron-emitting devices. In FIG. 12, the display panel comprises grid electrodes 120, each provided with a number of bores 121 for allowing electrons to pass therethrough and a set of external terminals 122, or Dox1, Dox2, . . . , Doxm, along with another set of external terminals 123, or G1, G2, Gn, connected to the respective grid electrodes 120 and an electron source substrate 110. The image forming apparatus of FIG. 12 differs from the image forming apparatus with a simple matrix arrangement of FIG. 8 mainly in that the apparatus of FIG. 12 has grid electrodes 120 arranged between the electron source substrate 110 and the face plate 86.

In FIG. 12, the stripe-shaped grid electrodes 120 are arranged between the substrate 100 and the face plate 86 perpendicularly relative to the ladder-like device rows for modulating electron beams emitted from the surface conduction electron-emitting devices, each provided with through bores 121 in correspondence to respective electron-emitting devices for allowing electron beams to pass therethrough. Note that, however, while stripe-shaped grid electrodes are shown in FIG. 12, the profile and the locations of the electrodes are not limited thereto. For example, they may alternatively be provided with mesh-like openings and arranged around or close to the surface conduction electron-emitting devices.

The external terminals 122 and the external terminals 123 for the grids are electrically connected to a control circuit (not shown).

An image-forming apparatus having a configuration as described above can be operated for electron beam irradiation by simultaneously applying modulation signals to the rows of grid electrodes for a single line of an image in synchronism with the operation of driving (scanning) the electron-emitting devices on a row by row basis so that the image can be displayed on a line by line basis.

Thus, a display apparatus according to the invention and having a configuration as described above can have a wide variety of industrial and commercial applications because it can operate as a display apparatus for television broadcasting, as a terminal apparatus for video teleconferencing, as an editing apparatus for still and movie pictures, as a terminal apparatus for a computer system, as an optical printer comprising a photosensitive drum and in many other ways.

Now, the present invention will be described by way of examples. However, it should be noted that the present invention is not limited thereto and they are subject to changes and modifications without departing from the scope of the invention.

[Examples 1-2, Comparative Example 1]

FIGS. 1A and 1B schematically illustrate electron-emitting devices prepared in these examples. The process employed for manufacturing each of the electron-emitting devices will be described by referring to FIGS. 3A through 3C.

Step-a:

In each example, after thoroughly cleansing a soda lime glass plate, a silicon oxide film was formed thereon to a thickness of 0.5 $\mu$m by sputtering to produce a substrate 1, on which a pattern of photoresist (RD-2000N-41: available from Hitachi Chemical Co., Ltd.) having openings was formed corresponding to the pattern of a pair of electrodes. Then, a Ti film and an Ni film were sequentially formed to respective thicknesses of 5 nm and 100 nm by vacuum evaporation. Thereafter, the photoresist was dissolved by an organic solvent and the Ni/Ti film was lifted off to produce a pair of device electrodes 4 and 5. The device electrodes was separated by a distance L of 10 $\mu$m and had a length W1 of 300 $\mu$m. (FIG. 3A)

Step-b:

To produce an electroconductive thin film 3, a mask of Cr film was formed on the device to a thickness of 100 nm by vacuum evaporation and then an opening corresponding to the pattern of an electroconductive thin film was formed by photolithography. Thereafter, an organic Pd solution (ccp4230: available from Okuno Pharmaceutical Co., Ltd.) was applied to the Cr film by means of a spinner and baked at 300° C. for 10 minutes in the atmosphere.

Step-c:

The Cr mask was removed by wet-etching and the PdO fine particle film was lifted off to obtain an electroconductive thin film 3 having a desired profile. (FIG. 3B)

Step-d:

The above described device was placed in the vacuum chamber 55 of a gauging system as illustrated in FIG. 5 and the vacuum chamber 55 of the system was evacuated by means of a vacuum pump unit 56 to a pressure of $1.3\times10^{-3}$ Pa for Example 1 and that of $1.3\times10^{-2}$ Pa for Example 2 and, thereafter, a mixture gas containing $N_2$ by 98% and $H_2$ by 2% was introduced into the vacuum chamber 55. For Comparative Example 1, the vacuum chamber was evacuated to a pressure of $1.3\times10^{-3}$ Pa but no mixture gas was introduced. Subsequently, a pulse voltage was applied between the device electrodes 4 and 5 to carry out an electric forming process and produce an electron emitting region 2 in the electroconductive thin film 3. The pulse voltage was a triangular pulse voltage whose peak value gradually increased with time as shown in FIG. 23B. The pulse width of T1=1 msec and the pulse interval of T2=10 msec were used. During the electric forming process, an extra rectangular pulse of 0.1V (not shown) was inserted into intervals of the forming pulse voltage in order to determine the resistance of the electron-emitting device and the electric forming process was terminated when the resistance exceeded 1MΩ. Then, the vacuum chamber was evacuated. By the end of this step, an electron-emitting region 2 was prepared for each example. (FIG. 3C)

During this step, the maximum current running through the device, or forming current $I_{form}$, the voltage applied to obtain the $I_{form}$, or $V_{form}$, and the product of the two values, or the forming power $P_{form}$ were also observed.

Table 1 shows the values obtained for the three parameters.

TABLE 1

| | $I_{form}$(mA) | $V_{form}$(V) | $P_{form}$(mP) |
|---|---|---|---|
| Example 1 | 8.0 | 9.8 | 78 |
| Example 2 | 7.1 | 9.9 | 71 |
| Com. Ex. 1 | 11.9 | 10.8 | 129 |

Step-e:

Subsequently, an activation process was carried out.

The pressure in the vacuum chamber 55 in this step was $1.3\times10^{-3}$ Pa. The activation process was conducted by applying a triangular pulse voltage with a wave height of 14V for 20 minutes.

Step-f:

Thereafter, a stabilization process was carried out. In this step, the vacuum pump unit 56 was switched from the set of a sorption pump and an ion pump to an ultrahigh vacuum pump unit and the device in the vacuum chamber 55 was heated to 120° C. for about 10 hours, keeping the pressure in the vacuum chamber 55 fairly low.

The anode 54 and the device were separated by a distance H of 5 mm and a voltage of 1 kV was applied to the anode 54 from the high voltage source 53.

A pulse voltage with a wave height of 14V was applied to the electron-emitting device to observe the device current If and the emission current Ie under this condition. The vacuum chamber showed an internal pressure of $4.3\times10^{-5}$ Pa.

For each of the devices, values of Ie=0.9 μA and If=1.0 mA were obtained.

[Example 3, Comparative Example 2]

The surface conduction electron-emitting device prepared in each of these examples was same as those of Examples 1 and 2 described above except that the distance between the device electrodes was equal to L=2 μm. By following Steps-a through c described above for Examples 1 and 2, a pair of device electrodes 4, 5 and an electroconductive thin film 3 were formed on a substrate 1 for each of Example 3 and Comparative Example 2. (FIG. 3B)

Step-d:

The device was placed in the vacuum chamber 55 and the vacuum chamber was evacuated. Then, for Example 3, acetone was introduced into the vacuum chamber 55 to raise the internal pressure to $1.3\times10^{-2}$ Pa. As in the case of Examples 1 and 2, a pulse voltage was applied between the device electrodes 2 and 3 for energization forming to produce an electron-emitting region 2 in the electroconductive thin film 3. (FIG. 3C)

For Comparative Example 2, no acetone was introduced and the vacuum chamber was evacuated to less than $1.3\times10^{-3}$ Pa before applying a pulse voltage for an energization forming process.

Table 2 shows the values of $I_{form}$, $V_{form}$ and $P_{form}$ obtained for Example 3 and Comparative Example 2.

TABLE 2

| | $I_{form}$(mA) | $V_{form}$(V) | $P_{form}$(mP) |
|---|---|---|---|
| Example 3 | 3.5 | 5.2 | 18 |
| Com. Ex. 2 | 10.0 | 6.0 | 60 |

Subsequently, an activation process and a stabilization process were carried out as in the case of Examples 1 and 2. When the electron-emitting performance was observed, the device of the Example 3 operated excellently as those of Examples 1 and 2.

[Example 4, Comparative Example 3]

In each of these example, an electron source comprising a large number of surface conduction electron-emitting devices arranged on a substrate and provided with a matrix wiring arrangement was prepared.

Figure 14:
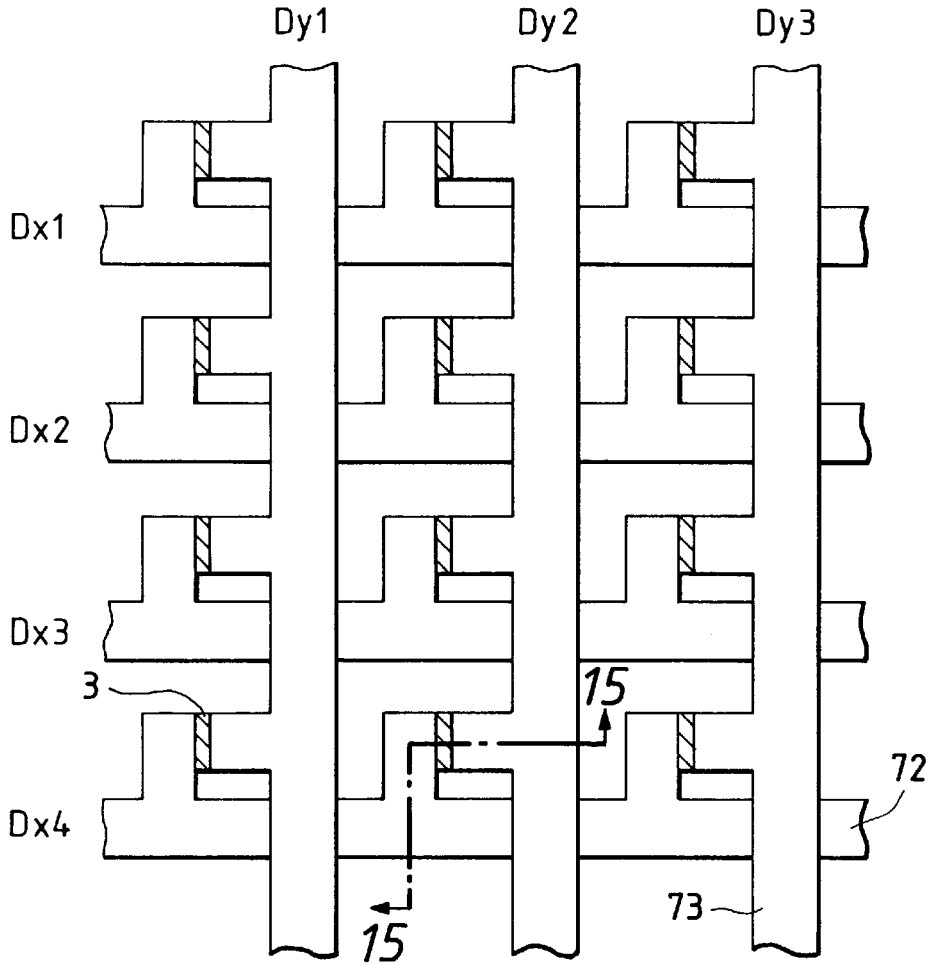
FIG. 14 is a schematic partial plan view of an electron source having a simple matrix arrangement prepared in Example 3.
Figure 15:
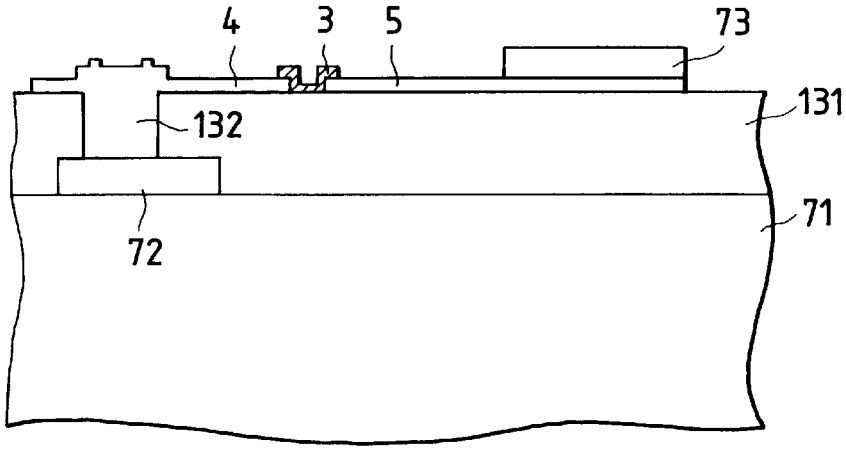
FIG. 15 is a schematic partial cross sectional view of the electron source of FIG. 14 taken along line 15–15.
Figure 16A:
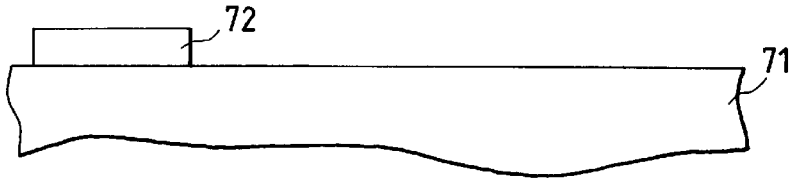
FIGS. 16A through 16H are schematic partial cross sectional views of the electron source of FIG. 14, illustrating different manufacturing steps.
Figure 16B:
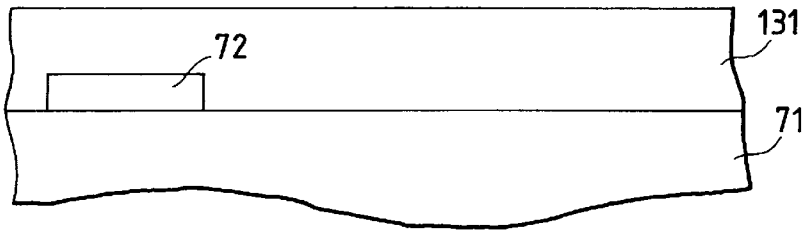
Figure 16C:
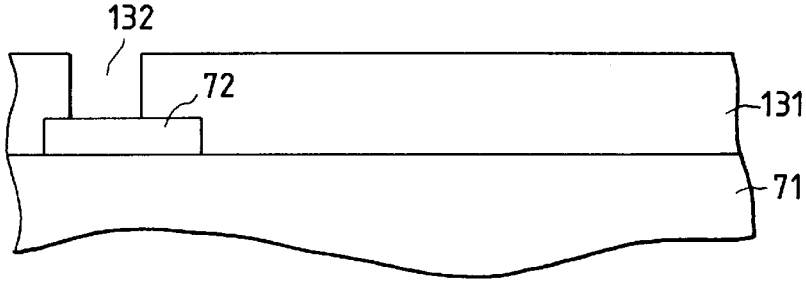
Figure 16D:
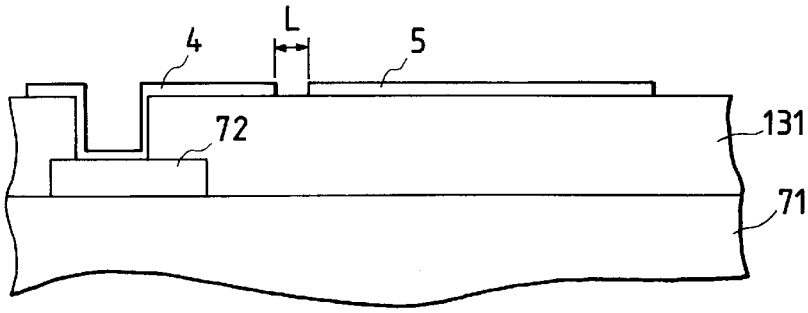
Figure 16E:
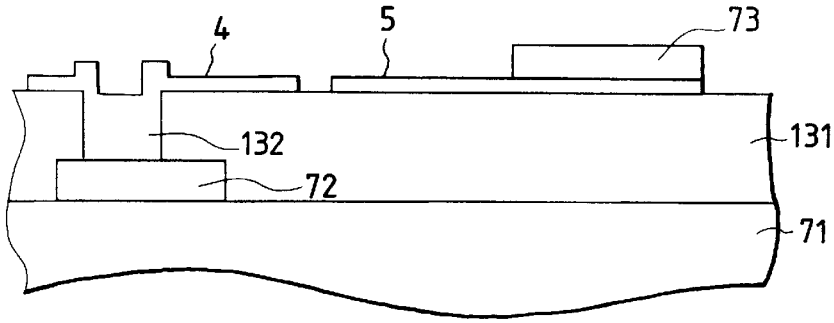
Figure 16F:
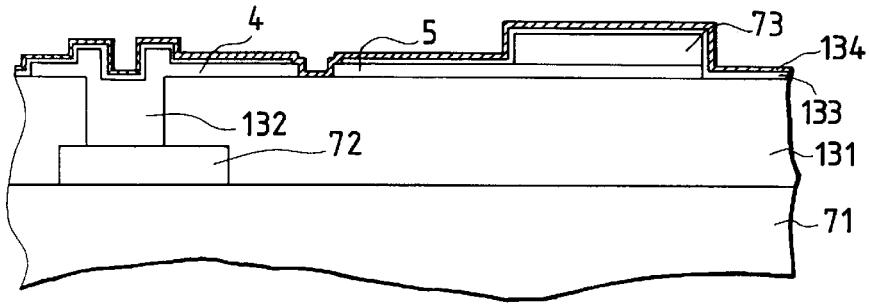
Figure 16G:
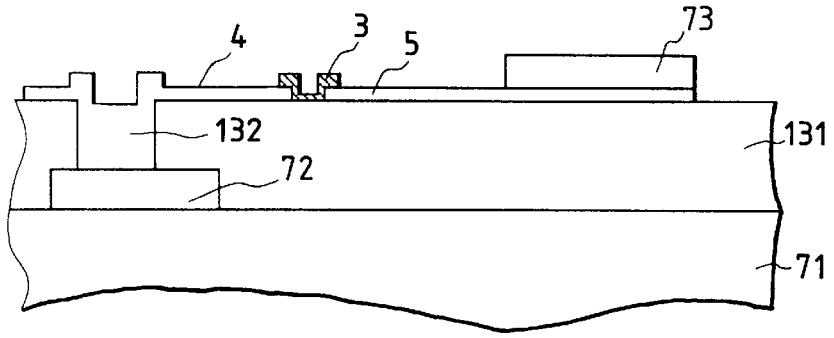
Figure 16H:
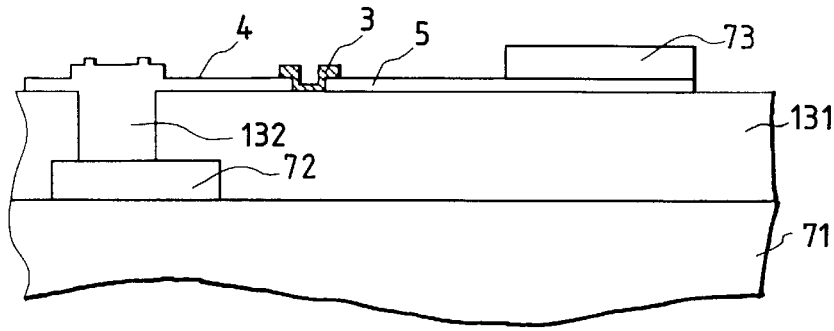

FIG. 14 is a partial plan view of the electron source prepared in these examples. FIG. 15 is a cross sectional view taken along line 15—15. Note that the components that are same or similar to each other in FIGS. 14, 15 and 16A through 16H are denoted by the same reference symbols.

71 denotes a substrate and 72 and 73 respectively denotes an X-directional wire (lower wire) and a Y-directional wire (upper wire). Otherwise, there are shown an electroconductive thin film 3, device electrodes 4 and 5, an interlayer insulation layer 131 and a contact hole 132 for electrically connecting the device electrode 4 and the lower wire 72.

Now, the method used for manufacturing the image-forming apparatus will be described in terms of an electron-emitting device thereof by referring to FIGS. 16A through 16H. Note that the following manufacturing steps, or Step-A through Step-H, respectively correspond to FIGS. 16A through 16H.

Step-A:

After thoroughly cleansing a soda lime glass plate a silicon oxide film was formed thereon to a thickness of 0.5 μm by sputtering to produce a substrate 72, on which Cr and Au were sequentially laid to thicknesses of 5 nm and 600 nm respectively and then a photoresist (AZ1370: available from Hoechst Corporation) was formed thereon by means of a spinner and baked. Thereafter, a photo-mask image was exposed to light and photochemically developed to produce a resist pattern for a lower wire 72 and then the deposited Au/Cr film was wet-etched to actually produce a lower wire 72 having a desired profile.

Step-B:

A silicon oxide film was formed as an interlayer insulation layer 131 to a thickness of 10 μm by RF sputtering.

Step-C:

A photoresist pattern was prepared for producing a contact hole 132 in the silicon oxide film deposited in Step-B, which contact hole 132 was then actually formed by etching the interlayer insulation layer 131, using the photoresist pattern for a mask. A technique of RIE (Reactive Ion Etching) using $CF_4$ and $H_2$ gas was employed for the etching operation.

Step-D:

Thereafter, a pattern of photoresist was formed for a pair of device electrodes 4 and 5 and a gap L separating the electrodes and then Ti and Ni were sequentially deposited thereon respectively to thicknesses of 5 nm and 50 nm by vacuum evaporation. The photoresist pattern was dissolved into an organic solvent and the Ni/Ti deposit film was treated by using a lift-off technique to produce a pair of device electrodes 4 and 5 having a width of W1=300 μm and separated from each other by a distance of L=10 μm.

Step-E:

A photoresist pattern was prepared for upper wire 73 on the device electrodes 4 and 5 and Ti and Au were sequentially deposited by vacuum evaporation to respective thicknesses of 5 nm and 500 nm. All the unnecessary portions of the photoresist was removed to produce an upper wire 73 having a desired profile by means of a lift-off technique.

Step-F:

Then, a Cr film 133 was formed to a film thickness of 100 nm by vacuum evaporation and patterned to produce a desired profile by using a mask having an opening for the gap L separating the device electrodes and its vicinity. A solution of Pd amine complex (ccp4230: available from Okuno Pharmaceutical Co., Ltd.) was applied onto the Cr film by means of a spinner and baked at 300° C. for 12 minutes to produce an electroconductive thin film 134 made of PdO fine particles and having a film thickness of 70 nm.

Step-G:

The Cr film 133 was removed along with any unnecessary portions of the electroconductive film 134 of PdO fine particles by wet etching, using an acidic etchant to produce an electroconductive thin film 3 having a desired profile. The electroconductive thin film 3 showed a film thickness of 7 nm and an electric resistance of $Rs=2.1\times10^4\Omega/\square$.

Step-H:

Resist was applied to the entire surface and exposed to light, using a mask. Then, the resist was photochemically developed and removed only in the area for a contact hole 132. Thereafter, Ti and Au were sequentially deposited by vacuum evaporation to respective thicknesses of 5 nm and 500 nm and the contact hole 132 was buried by removing the unnecessary area by means of a lift-off technique.

As a result of the above steps, a lower wire 72, an interlayer insulation layer 131, an upper wire 73, a pair of device electrodes 4 and 5 and an electroconductive thin film 3 were formed on the substrate 71 for each device so that, as a whole, a plurality of electroconductive thin films 3 were connected by lower wires 73 and upper wires 72 to form a matrix wiring pattern on the substrate of an electron source, which was to be subjected to an energization forming process.

Then, the prepared electron source substrate that had not been subjected to energization forming was used to prepare an image-forming apparatus by following the steps described below. This will be described by referring to FIGS. 8, 9A and 9B.

After securing an electron source substrate 71 onto a rear plate 81, a face plate 86 (carrying a fluorescent film 84 and a metal back 85 on the inner surface of a glass substrate 83) was arranged 5 mm above the substrate 71 with a support frame 82 disposed therebetween and, subsequently, frit glass was applied to the contact areas of the face plate 86, the support frame 82 and the rear plate 81 and baked at 400° C. in the atmosphere for 10 minutes to hermetically seal the container. The substrate 71 was also secured to the rear plate 81 by means of frit glass.

While the fluorescent film 84 is consisted only of a fluorescent body if the apparatus is for black and white images, the fluorescent film 84 of this example (FIG. 9A) was prepared by forming black stripes 91 in the first place and filling the gaps with stripe-shaped fluorescent members 92 of primary colors. The black stripes 91 were made of a popular material containing graphite as a principal ingredient. A slurry technique was used for applying fluorescent materials onto the glass substrate 71.

A metal back 85 is arranged on the inner surface of the fluorescent film 84. After preparing the fluorescent film, the metal back 85 was prepared by carrying out a smoothing operation (normally referred to as "filming") on the inner surface of the fluorescent film 84 and thereafter forming thereon an aluminum layer by vacuum evaporation.

For the above bonding operation, the components were carefully aligned in order to ensure an accurate positional correspondence between the color fluorescent members and the electron-emitting devices.

The image forming apparatus was then placed in a vacuum processing system and the vacuum chamber was evacuated to reduce the internal pressure to less than $1.3\times10^{-3}$ Pa. Thereafter, a mixture gas of $N_2$ and $H_2$ containing by 98% and 2% respectively was introduced into the vacuum container until the internal pressure rose to $5\times10^{-2}$ Pa.

Figure 21:
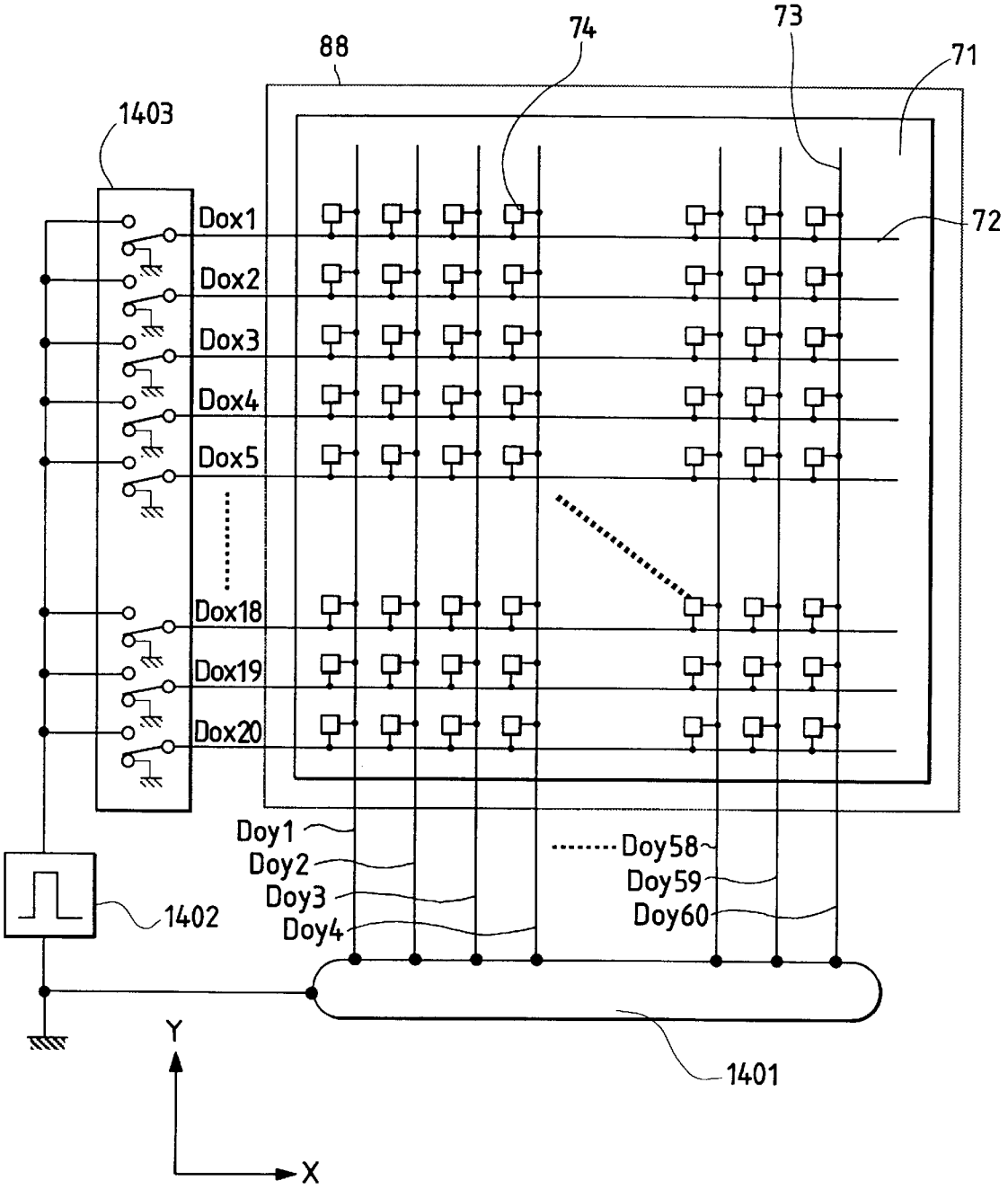
FIG. 21 is a schematic diagram of the circuit used for energization forming for the image-forming apparatus of Example 11.

FIG. 21 shows a schematic diagram of the wiring arrangement used for applying a pulse voltage in each of these examples. Referring to FIG. 21, the Y-directional wires 73 were commonly connected to a common electrode 1401 and further to a ground side terminal of a pulse generator 1402 by connecting their external terminals Doy1 through Doyn to the common electrode 1401. The X-directional wires 72 were connected to a control switching circuit 1403 by way of their external terminals Dox1 through Doxm. (In FIG. 21, m=20 and n=60.) The switching circuit was designed to each of the terminals either to the pulse generator 1402 or to the ground as schematically illustrated in FIG. 21.

For an energization forming process, one of the device rows arranged along the X-direction was selected by the switching circuit 1403, to which a pulse voltage was applied, and after the application of the pulse voltage, another device row was selected for pulse voltage application. In this manner, all the device rows were subjected to the pulse voltage application simultaneously. The applied pulse voltage was similar to the one used in Example 1 or 2.

An energization forming process as described above was also conducted on the apparatus of Comparative Example 3 except that no mixture gas was introduced and the vacuum chamber was evacuated to $1.3\times10^{-3}$ Pa before the apparatus was subjected to an energization forming process, using a similar pulse voltage.

Thereafter, an activation process was carried out. At this stage of operation, the vacuum chamber showed a pressure of $2.7\times10^{-3}$ Pa. A triangular pulse voltage having a wave height of 14V and a pulse width of 30 $\mu$sec was applied to the device rows as in the case of energization forming.

After the activation process, the envelope was evacuated again to reduce the internal pressure to about $1.3\times10^{-4}$ Pa, while heating the vacuum chamber, and the exhaust pipe (not shown) was heated to melt by a gas burner to hermetically seal the envelope. Finally, the getter (not shown) arranged in the envelope was heated by high frequency heating to carry out a getter process.

The image-forming apparatus produced after the above steps was then driven to operate by applying a scan signal and a modulation signal from a signal generator (not shown) to the electron-emitting devices, using the simple matrix wiring, to cause the electron-emitting devices to sequentially emit electrons. Then, the emission current Ie was observed for each device to determine the variances in the performance of the devices. The variances were found within a 5% range for the apparatus of Example 4 and within a 15% range for the apparatus of Comparative Example 3 to prove that the former was by far excellent than the latter.

It may be safe to assume that the superior performance of the former was a result of the energization forming process conducted in an atmosphere containing a substance that promoted the cohesion of the electroconductive thin film so that a lower electric current was required for energization forming and hence a smaller voltage drop due to the resistance of the wires reduced the variances in the voltage applied to the devices for energization forming, which provided uniform conditions for the devices.

[Examples 5-1 through 5-6, Comparative Example 4]

In each of these examples, an electron-emitting device having a configuration as schematically illustrated in FIGS. 1A and 1B was prepared. These examples will be described by referring to FIGS. 3A through 3C.

Step-a:

In each example, after thoroughly cleansing a substrate 1 of quartz glass with a detergent, pure water and an organic solvent, Pt was deposited for device electrodes by sputtering on the substrate 1 to a thickness of 50 nm. The device electrodes 4, 5 were formed by covering the substrate 1 with a mask having openings corresponding to the profiles of the device electrodes, which were separated by a distance L of 3 $\mu$m. (FIG. 3A)

Step-b:

To produce an electroconductive thin film 3, a mask of Cr film (not shown) was formed on the device to a thickness of 50 nm by vacuum evaporation and then an opening corresponding to the pattern of an electroconductive thin film was formed by photolithography. The opening had a width of 100 $\mu$m.

Step-c:

Thereafter, an organic Pd solution (ccp4230: available from Okuno Pharmaceutical Co., Ltd.) was applied to the Cr film by means of a spinner and baked at 310° C. in the atmosphere to produce an electroconductive thin film 3 containing fine particles (with an average diameter of 5 nm) of palladium oxide (PdO) as a principal ingredient. The film thickness was about 6 nm. Then, the Cr mask was removed by wet-etching and the PdO fine particle film was lifted off for an electroconductive thin film 3 having a desired profile. The electroconductive thin film 3 showed a resistance of $Rs=4.0\times10^{4}\Omega/\square$. (FIG. 3B)

Step-d:

The above described device was placed in the vacuum chamber 55 of a gauging system as illustrated in FIG. 5 and a pulse voltage was applied between the device electrodes 4 and 5 from the power source 51 for applying a device voltage Vf to carry out an electric forming process and produce an electron emitting region 2 in the electroconductive thin film 3.

The pulse voltage used for energization forming was a rectangular pulse voltage as shown in FIG. 4A by referring to Example 5 above. In the initial stages, the pulse wave height was gradually raised with time until it got to Vh. From then on the level of Vh was maintained for a time period of Th. The pulse width of T1=1 msec and the pulse interval of T2=100 msec were used. The duration of time Th was 10 minutes. The wave height voltage Vh was 6V for Example 5-1, 10V for Example 5-2, 14V for Example 5-3 and 18V for Example 5-4. Two devices were used for each condition. While the pulse wave height was held to Vh, the resistance of the device rose gradually and the current running through the device fell gradually. After 10 minutes, T1 was modified to 5 msec. Then, after applying several pulses, the resistance of the device rose beyond 1MΩ, when the energization forming process was terminated. (FIG. 3C)

Figure 19:
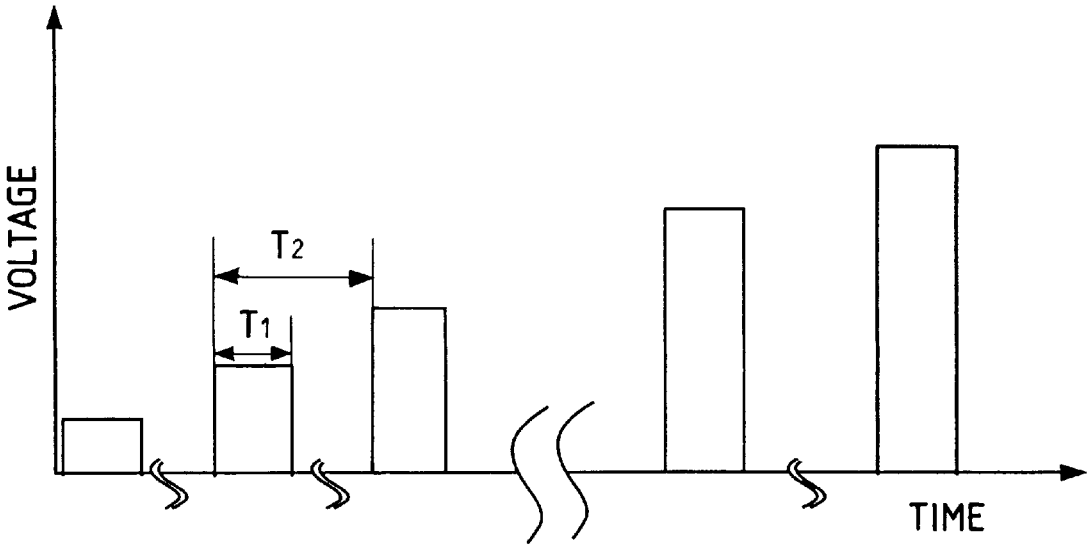
FIG. 19 is a graph showing the voltage waveform used for energization forming in Comparative Example 1.
Figure 20:
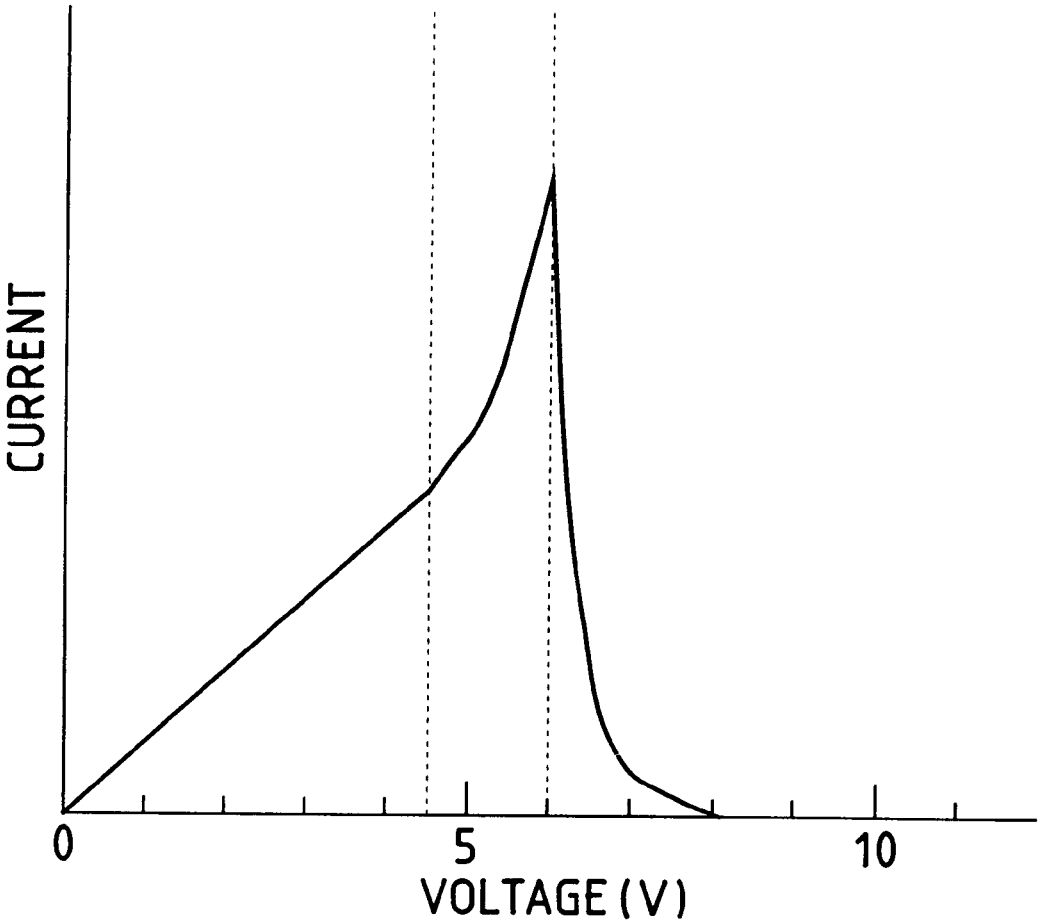
FIG. 20 is a graph showing the relationship between the voltage and the current observed in the energization forming process of Comparative Example 1.

A rectangular pulse voltage as shown in FIG. 19 was applied to the device of Comparative Example 4, selecting values of T1=1 msec and T2=10 msec. The pulse wave height was gradually increased from 0V. FIG. 20 shows the relationship between the current running through the device and the wave height of the applied pulse voltage. The device showed a constant resistance until the voltage got to 4.5V, when the resistance started falling a little and then rose rapidly when the voltage fell to the lowest level of 6V. The energization forming process was terminated when the resistance exceeded 1MΩ.

One of the two devices for each of Examples 5-1 through 5-4 and that of Comparative Example 4 was observed for the electron-emitting region through an electron microscope.

Step-e:

Subsequently, an activation process was carried out for the other of the two devices for each example by placing it in a vacuum chamber 55. For this process, acetone was introduced into the vacuum chamber 55, and a rectangular pulse voltage having a wave height of 15V, a pulse width of 1 msec and a pulse interval of 10 msec was applied between the device electrodes 4 and 5 for 15 min at $1.3\times10^{-2}$ Pa.

Step-f:

A stabilization process was then carried out. The vacuum chamber was evacuated, while heating for 6 hours until the pressure in the vacuum chamber 55 got to about $10^{-6}$ Pa.

Additionally, electron-emitting devices were prepared for Examples 5-5 and 5-6 as in the case of Examples 5-1 and 5-3 except that a duration of 25 minutes was selected for the activation process.

Each of the prepared devices was driven to operate in the vacuum chamber, keeping the internal pressure unchanged, to observe the device current If and the emission current Ie.

The anode 54 and the device were separated by a distance H of 5 mm and a voltage of 1kV was applied to the anode 54 from the high voltage source 53. A pulse voltage with a wave height of 15V was applied to the electron-emitting device. The device electrode 4 was the anode and the device electrode 5 was the cathode of the device.

Table 3 shows the results of the observation.

TABLE 3

| | Vh (V) | activation time (min) | If (mA) | Ie (μA) | fissure width (nm) | voltage applicable length (nm) |
|---|---|---|---|---|---|---|
| Example 5-1 | 6 | 15 | 1.0 | 1.5 | 20 | 3.0 |
| Example 5-2 | 10 | 15 | 0.9 | 1.3 | 30 | 4.5 |
| Example 5-3 | 14 | 15 | 0.9 | 1.1 | 50 | 5.0 |
| Example 5-4 | 18 | 15 | 0.7 | 0.9 | 100 | 6.0 |
| Example 5-5 | 6 | 25 | 1.0 | 1.5 | 20 | 3.0 |
| Example 5-6 | 14 | 25 | 1.0 | 1.4 | 50 | 3.5 |
| Com. Ex. 4 | — | — | 1.2 | 1.0 | 40–100 | 5.5 |

As a result of observations through an electron microscope, the devices with Vh=6V, 10V and 14V of the Examples 5 group showed a uniformly profiled fissure with a width of not greater than 50 nm over the entire length of the electron-emitting region. In the case of the device with Vh=18V, the fissure width exceeded 50 nm but showed a substantially uniform value. To the contrary, the device of comparative Example 4 showed a fissure having a width that varied randomly between 40 and 100 nm so that no median could not be determined.

In every one of the devices subjected to the activation process and the subsequent processes in the above Examples 5 group, a carbon film was formed substantially over the entire electron-emitting region 2 to reveal that electrons had been emitted from the entire surface of the electron-emitting region 2. In the case of the device of Comparative Example 4, on the other hand, no carbon film was formed on part of the electron-emitting region 2. This may be related to the level of the emission current Ie.

Each of the devices of Examples 5 group showed a device current If smaller than that of the device of Comparative Example 4. This may be because a uniform fissure was formed in the electron-emitting region of the former device, which was therefore uniformly activated in the subsequent activation step to suppress the generation of any leak current. Since the fissure of the electron-emitting region of the device of Comparative Example 4 was not uniform, the electron-emitting region might have been unevenly activated to produce a path of leak current in part of the region.

When the devices of Examples 5-1 and 5-3 are compared with those of Examples 5-5 and 5-6, it is recognized that the device having a fissure width of 20 nm did not show any changes in Ie and If although a longer duration was used for the activation step nor in the voltage applicable length. However, both Ie and If of the device having a fissure width of 50 nm rose considerably to prove that it had a reduced voltage applicable length. From these observations, it is clear that the voltage applicable length can be reduced and Ie can be increased by prolonging the duration of the activation process if a uniform fissure width is achieved. However, it should be noted that the limit of the voltage applicable length is 3.0 nm under the above cited conditions for activation. In other words, both Ie and the voltage applicable length of devices can be held to a substantially constant level by using a long period of time for activation even if the fissure width of the devices show relatively large variances. The time required to get to the limit value can be reduced by using a short fissure width.

[Examples 6-1 through 6-4, Comparative Example 5]

Devices of Example 6-1 through 6-4 were prepared by following the steps of Examples 5-1 through 5-4. The procedures used for measuring the performance of and observing the devices were also same as those used in the preceding examples.

The energization forming process of the devices of the Examples 6 group was conducted in an $H_2$ containing atmosphere with a pressure level of 1.3 Pa. For each of the device, the energization forming process was terminated when the resistance of the device exceeded 1MΩ, while applying a pulse voltage of Vh.

For the device of Comparative Example 5, the energization forming process was conducted in vacuum of a degree of pressure of $1.3\times10^{-5}$ Pa with T1=1 msec, T2=0 msec and Vh=6V for 30 minutes. The resistance of the device increased gradually but never exceeded 1M Table 4 shows the results of the observation.

TABLE 4

| | Vh (V) | If (mA) | Ie (μA) | fissure width (nm) | voltage applicable length (nm) |
|---|---|---|---|---|---|
| Example 6-1 | 6 | 1.0 | 2.0 | 15 | 3.0 |
| Example 6-2 | 10 | 0.9 | 1.8 | 20 | 3.5 |
| Example 6-3 | 14 | 0.8 | 1.7 | 50 | 4.0 |
| Example 6-4 | 18 | 0.8 | 1.3 | 80 | 5.0 |
| Com. Ex. 5 | 6 | 1.5 | 1.0 | ≧35 | ≧5.0 |

As a result of observations through an electron microscope, the devices with Vh=6V, 10V and 14V of the Examples 6 group showed a uniformly profiled fissure with a width of not greater than 50 nm over the entire length of the electron-emitting region. In the case of the device with Vh=18V, the fissure width exceeded 50 nm but showed a substantially uniform value. To the contrary, the device of Comparative Example 5 showed a fissure having a width less than 35 nm and insufficient so that the electroconductive thin film might have been bridged at certain locations.

In every one of the devices subjected to the activation process and the subsequent processes in the above Examples 6 group, a carbon film was formed substantially over the entire electron-emitting region 2 to reveal that electrons had been emitted from the entire surface of the electron-emitting region 2. In the case of the device of Comparative Example 5, on the other hand, no carbon film was formed on part of the electron-emitting region 2. This may be related to the level of the emission current Ie.

Each of the devices of Examples 6 group showed a device current If smaller than that of the device of Comparative Example 5. This may be because a uniform fissure was formed in the electron-emitting region of the former device, which was therefore uniformly activated in the subsequent activation step to suppress the generation of any leak current. The fissure of the electron-emitting region might have been bridged at certain locations in the device of Comparative Example 5 to provide one or more than one paths of leak current in the region.

As may be understood by comparing Tables 3 and 4, a reduction in the fissure width and the voltage applicable length and an increase in the emission current were observed in the devices of the Examples 6 group when compared with those of Examples 5 group. This may be because the energization forming process was conducted for the former devices in an $H_2$ containing atmosphere to promote the chemical reduction and the cohesion of the electroconductive thin film whereas the process was conducted in vacuum for the latter devices. Thus, obviously, the power consumption in the energization forming process for the former devices was reduced to narrow the fissures.

For the device of Comparative Example 5, the leak current paths might have been formed because T1 was not prolonged after the applied pulse voltage got to Vh and held to that level.

[Examples 7-1 through 7-4]

Devices of these examples were prepared by following the steps of Examples 5-1 through 5-4.

In each of these examples, the electroconductive thin film 3 was formed by sputtering Pt. The electroconductive thin film 3 showed a film thickness of about 2.5nm and an electric resistance of Rs=$3.5\times10^{-4}$ Ω/□.

The atmospheres in the vacuum chamber for the energization forming process of Examples 7-1 through 7-4 were (1) vacuum (about $1.3\times10^{-4}$ Pa), (2) $H_2$ 1.3 Pa, (3) CO 130 Pa, (4) acetone $1.3\times10^{-3}$ Pa respectively. The applied pulse voltage had T1=1 msec., T2=100 msec., Vh=10V and Th=10 min. Although the resistance rose gradually, it did not exceed 1MΩ except the example where $H_2$ was used. When the pulse wave height was raised to 12V, the resistance exceeded 1MΩ after applying several pulses and therefore the energization forming process was terminated then in each example.

After the energization forming process, the entire vacuum chamber 55 was heated to 180° C. and evacuated for 6 hours to reduce the internal pressure to about $1.3\times10^{-6}$ Pa for an activation process.

Table 5 shows the results of the observation.

TABLE 5

| | atmosphere | If (mA) | Ie (μA) | fissure width (nm) | voltage applicable length (nm) |
|---|---|---|---|---|---|
| Example 7-1 | vacuum | 1.0 | 1.5 | 15 | 3.5 |
| Example 7-2 | $H_2$ | 0.9 | 2.0 | 10 | 3.0 |
| Example 7-3 | CO | 1.0 | 1.4 | 15 | 4.0 |
| Example 7-4 | acetone | 1.0 | 1.4 | 15 | 4.0 |

As a result of observations through an electron microscope, all the devices showed a fissure with a uniform width of less than 20 nm over the entire electron-emitting region after having been subjected to energization forming. The fissure width of each of the devices of this example group was smaller than that of any of the devices of the Examples 5 and 6 groups and Comparative Examples 4 and 5. This may be explained by the fact that the fissure width varies depending on the material of the electroconductive thin film and the material of the electroconductive thin film of these devices has a melting point higher than the materials of the preceding examples.

After the activation process, each of the devices of this example group showed a carbon film uniformly formed on the entire electron-emitting region 2 to prove that electrons had been emitted substantially from the entire surface of the electron-emitting region.

While the devices of this example group showed a device current smaller than that of any of the devices of Comparative Examples 4 and 5. This may be because no path of leak current was formed as a uniform fissure was formed there and the electron-emitting region was uniformly activated in each of the devices of this example group.

As may be understood by seeing Table 5, the device for which the energization forming process was conducted in an $H_2$ containing atmosphere showed a smaller fissure width and a greater emission current than any other devices. This may be because the cohesion of the electroconductive thin film (Pt) was promoted by the existence of $H_2$ and the energization forming process was performed at a reduced current level to consequently reduce the fissure width. On the other hand, CO and acetone did not show any effect for promoting the cohesion of Pt particles as in the case of vacuum.

[Examples 8-1 and 8-2]

Devices of these examples were prepared as in the case of Examples 5-1 through 5-4 except the following.

In each of these examples, the electroconductive thin film 3 was made of PdO fine particles as in the case of the Examples 5 group. The pulse voltage used for energization forming was a rectangular pulse with T1=1 msec., T2=100 msec. and Vh=6.0V. The resistance raised gradually, while Vh=6.0V was being maintained, and the energization forming process was terminated when the pulse wave height was raised to 7.0V and the resistance went beyond 1MΩ.

The atmospheres in the vacuum chamber for the energization forming process of Examples 8-1 and 8-2 were (1) CO 13 Pa and (2) acetone $1.3\times10^{-3}$ Pa respectively.

Table 6 shows the results of observation.

TABLE 6

| | atmosphere | If (mA) | Ie (μA) | fissure width (nm) | voltage applicable length (nm) |
|---|---|---|---|---|---|
| Example 8-1 | CO | 1.0 | 1.6 | 25 | 3.5 |
| Example 8-2 | acetone | 1.0 | 1.6 | 28 | 3.2 |

As described above, CO and acetone did not show any effect for promoting the cohesion of the electroconductive thin film in the Examples 7 group, where the electroconductive thin film was made of Pt. Contrary to this, the chemical reduction and the resultant cohesion of the electroconductive thin film were promoted in this example group to reduce the power consumption for the energization forming process and also the fissure width. The use of other easily reducible metal oxides for electroconductive thin films may provide similar effects.

[Examples 9-1 through 9-5]

Devices of these examples were prepared as in the case of Examples 5-1 through 5-4 except the following.

In these examples, the energization forming process was conducted in vacuum of $1.3x10\times10^{-4}$ Pa and the pulse voltage used for energization forming was a rectangular pulse with T1=1 msec and with variable T2 of (1) 2 msec, (2) 5 msec, (3) 10 msec, (4) 100 msec and (5) 1 sec for respective examples. A constant voltage of Vh=6.0V was selected. The resistance raised gradually, while Vh=6.0V was being maintained, and thereafter, Vh was raised to 7.0V to see that the resistance of the device went beyond 1MΩ, when the energization forming process was terminated.

Table 7 shows the results of observation.

TABLE 7

| | T2 (msec) | If (mA) | Ie (μA) | fissure width (nm) | voltage applicable length (nm) |
|---|---|---|---|---|---|
| Example 9-1 | 2 | 1.0 | 0.8 | 50 | 4.5 |
| Example 9-2 | 5 | 1.0 | 1.0 | 45 | 4.2 |
| Example 9-3 | 10 | 1.0 | 1.2 | 40 | 4.0 |
| Example 9-4 | 100 | 1.0 | 1.5 | 30 | 3.0 |
| Example 9-5 | 1,000 | 1.0 | 1.5 | 30 | 3.0 |

It will be seen from Table 7 above that the fissure width, the voltage applicable length and the electron-emitting performance are dependent on the pulse interval T2 used for energization forming. This may be due to the fact that, if the pulse interval T2 is not large relative to the pulse width T1, the heat generated by the application of a pulse voltage is accumulated in the device to raise the temperature of the electron-emitting region and enlarge the fissure width. Therefore, T2 is preferably five times, more preferably ten times and most preferably one hundred times greater than T1.

[Example 10, Comparative Example 6]

Figure 13:
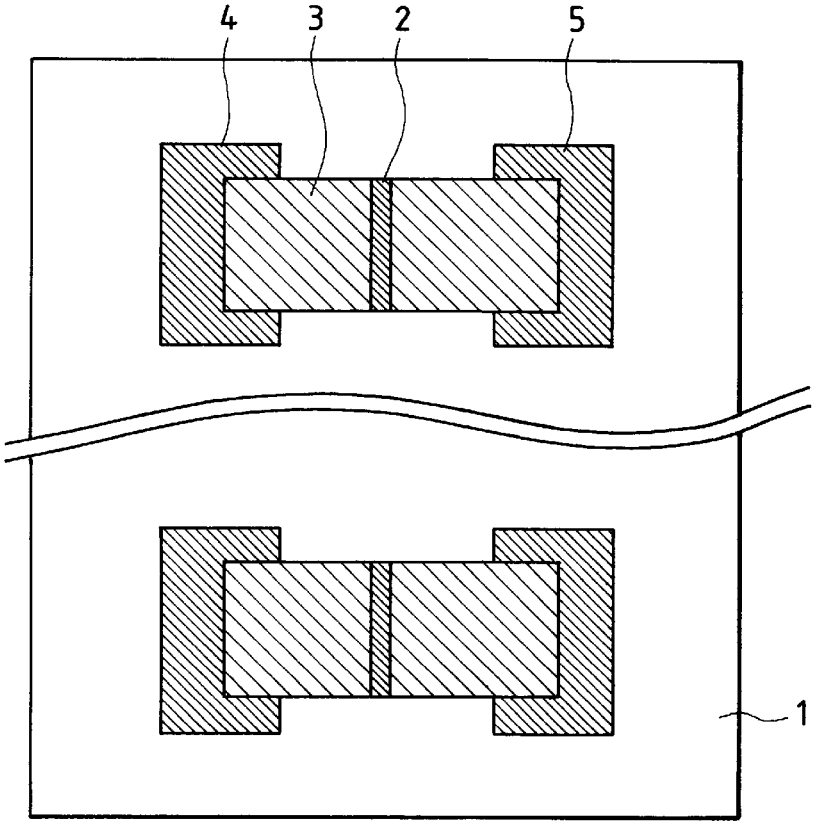
FIG. 13 is a schematic plan view of a surface conduction electron-emitting device prepared in Example 1.

In each of these examples, a plurality of devices were prepared on a single substrate as shown in FIG. 13, each of the devices having a configuration as shown in FIGS. 1A and 1B. The devices of these examples were prepared, measured and observed by following the steps of Examples 5-1 through 5-4.

In each of these examples, the electroconductive thin film 3 of each device was formed by sputtering Pt. The electroconductive thin film 3 showed a film thickness of about 1.5 mn and an electric resistance of $Rs=5\times10^4\Omega/\square$.

The energization forming process of each of the examples was conducted in vacuum of about $1.3\times10^{-4}$ Pa. The applied pulse voltage had T1=1 msec, T2=100 msec, Vh=5.5V and Th=10 min. After holding the voltage to the predetermined period of time, T1 was changed to 5 msec and the resistance of the devices went beyond 1 MΩ, when the energization forming process was terminated.

The voltage was a rectangular pulse voltage with a gradually increasing wave height as in Comparative Example 1 for both examples.

A device voltage Vf of 22V was used for Example 10, whereas 18V was selected for the device voltage of Comparative Example 6. If and Ie were observed particularly from the viewpoint of variances.

Table 8 shows the results of the observation.

TABLE 8

| | Vf (V) | If (mA) | ΔIf (%) | Ie (μA) | ΔIe (%) | fissure width (nm) |
|---|---|---|---|---|---|---|
| Example 10 | 32 | 1.0 | 4.8 | 1.1 | 4.6 | 50 |
| Com. Ex. 6 | 18 | 1.1 | 26 | 1.0 | 31 | 40–100 |

As a result of observations through an electron microscope, the device of Example 10 showed fissures with a uniform width of less than 50 nm over the entire electron-emitting region after having been subjected to energization forming, whereas the device of Comparative Example 6 that had been subjected up to the energization forming process showed uneven fissures with a width varying from 40 to 100 nm.

In each of the devices that had undergone the steps after the activation process, a carbon film was formed on the entire electron-emitting region to prove that electrons had been emitted from the entire surface area of that region. Contrary to this, part of the electron-emitting region 2 of the devices of Comparative Example 6 was devoid of carbon film.

Thus, the devices prepared according to the invention realized a uniform electron-emitting performance.

[Example 11]

The device of these example was prepared as in the case of Examples 5-1 through 5-4 except the following.

In this example, the device electrodes were separated by a distance L of 2 μm. The electroconductive thin film was made of fine particles of PdO as in the case of the Examples 5 group and showed a film thickness of about 6 nm and a resistance of $Rs=4.2\times10^4\Omega/\square$. The energization forming process was conducted in vacuum of $10^{-6}$ Pa and the pulse voltage used for energization forming was a rectangular pulse with T1=1 msec, T2=100 msec, Vh=5.5V and Th=10 min. After the predetermined time, T1 was changed to 5 msec to see that the resistance of the device exceeded 1MΩ, when the energization forming process was terminated.

The activation process was conducted in a vacuum chamber 55, introducing $WF_6$ to realized an internal pressure of $1.3\times\ ^{-1}$ Pa. At this time, a rectangular pulse voltage of T1=2 msec, T2=10 msec. and a wave height of 20V was applied. The substrate was heated to 150° C.

For the stabilization process, the vacuum chamber was heated to 200° C. and evacuated for 2 hours until the pressure went down to about $10^{-6}$ Pa.

For observing the performance a pulse voltage with a wave height of 20V was applied to the device.

Table 9 shows the results of observation.

TABLE 9

| | If | Ie | fissure width | voltage applicable length |
|---|---|---|---|---|
| | (mA) | (μA) | (nm) | (nm) |
| Example 11 | 1.0 | 2.0 | 30 | 3.8 |

As a result of observations through an electron microscope, the device of this example showed a uniform fissure with a width of 30 nm over the entire length of the electron-emitting region 2 when the energization forming process was completed. When the steps after the activation process were over, a film of W deposit was observed on the entire electron-emitting region 2 to prove that electrons had been emitted from the entire surface of the electron-emitting region.

Thus, the devices prepared according to the invention realized a uniform and excellent electron-emitting performance.

[Example 12, Comparative Example 7]

Devices of these examples were prepared by following the steps of Examples 5-1 through 5-4.

In each of these examples, the device electrodes were formed by depositing Ni by means of sputtering. The device electrodes were separated by a length L of 50 μm. The electroconductive thin film was made of PdO fine particles and had a film thickness of lOnm. The film showed a resistance of Rs=$8\times10^4\Omega/\square$.

In Example 12, a triangular pulse voltage as shown in FIG. 23A with T1=100 μsec and T2=10 msec was used for the energization forming process. The pulse wave height was held to a constant level of 10V. The electric current running through the device showed a peak value of 2.5 mA. The atmospheres in the vacuum chamber was initially equal to $1.3\times10^{-4}$ Pa, which was then raised to $1.3\times10^3$ Pa by introducing a mixture gas of $H_2$2%-$N_2$98%.

The electric current running through the device gradually fell after the introduction of the mixture gas, then rose to 8.5 mA from the time at 3 minutes after the start of the gas introduction and suddenly dropped to less than 10 nA. The maximum power consumption rate during this period was 85 mW.

The device of Comparative Example 7 was subjected to energization forming by applying a triangular pulse voltage with an increasing wave height as shown in FIG. 23B. The initial wave height was 5V, which was gradually raised to 14V, when the energization forming process was terminated. The maximum electric current was 10.5 mA and the maximum power consumption rate was 147mW during this period. The vacuum chamber was held to $1.3\times10^{-4}$ Pa. If and Ie of each device were observed by applying a rectangular pulse voltage of 20V to the device.

Table 10 shows the results of the observation.

TABLE 10

| | atmosphere | If (mA) | Ie (μA) |
|---|---|---|---|
| Example 12 | $H_2$-$N_2$ | 1.5 | 1.8 |
| Com. Ex. 7 | vacuum | 0.8 | 1.2 |

[Example 13]

A device of this example was prepared by following the steps of Examples 8-1 and 8-2.

In Example 13, a rectangular pulse voltage with T1=100 μsec and T2=16.7 msec. was used for the energization forming process. The pulse wave height was held to a constant level of 10V. The electric current running through the device showed a peak value of 1.7mA. Under this condition, a mixture gas of $H_2$1%-Ar99% was gradually introduced into the vacuum chamber until the pressure rose to $1.3\times10^3$ Pa. The energization forming process was terminated about five minutes after the start of introducing the mixture gas. If and Ie of the device were observed by applying a pulse voltage of 18V to the device.

Table 11 shows the results of the observation.

TABLE 11

| | If (mA) | Ie (μA) |
|---|---|---|
| Example 13 | 1.5 | 2.1 |

[Examples 14-1 through 14-3, Comparative Example 8]

In each of these example, electron sources, each comprising a large number of surface conduction electron-emitting devices arranged on a substrate and provided with a matrix wiring arrangement was prepared and incorporated into respective image-forming apparatuses as in the case of Example 4. Electron-emitting devices were arranged into a matrix of 20 rows and 60 columns including ones for primary colors.

Steps-A through H and the hermetically sealing procedures of Examples 4 were followed for these examples. However, for each device, the device electrodes were separated by a distance of L=3 μm and had a length of W1=200 μm. A Pt electroconductive thin film was produced by sputtering to a thickness of 1.5 nm. The Cr mask used for patterning had a thickness of 50 nm. The electric resistance of the electroconductive thin film was Rs=$5\times10^4\Omega/\square$.

After completing the hermetically sealing operation, three pairs of image-forming apparatuses were subjected to energization forming by using respectively methods A through C, which will be described below. For Comparative Example 8, another pair of image-forming apparatuses were also subjected to energization forming by using a fourth method, or method D, which will also be described below. One of each pair of apparatuses was observed through an electron microscope after the energization forming process.

As shown in FIG. 21, the Y-directional wires 73 were commonly connected to a common electrode 1401 and further to a ground side terminal of a pulse generator 1402 by connecting their external terminals Doy1 through Doy60 to the common electrode 1401. The X-directional wires 72 were connected to a control switching circuit 1403 by way of their external terminals Dox1 through Dox20. The switching circuit was designed to each of the terminals either to the pulse generator 1402 or to the ground as schematically illustrated in FIG. 21.

Method A:

The envelope 88 was evacuated through an exhaust pipe by means of a vacuum system until the internal pressure fell under $1.3\times10^{-4}$ Pa. and then a pulse voltage was applied to the devices. The wave height of the pulse voltage was gradually raised from 0V to get to 6V, when the wave height was held to the that level. The pulse width was T1=100 μsec. and the pulse interval was T2=833 μsec., which was equivalent to a frequency of f=1,200 Hz. At the same time, the switching control circuit 1403 was connected to the pulse generator 1402 by one of the external terminals Dox1 through Dox20 and also to the ground in order to select one of the device rows cyclically in synchronism to the T2. Thus, a pulse voltage with a pulse width of T1=100 μm and a pulse interval of T2=16.7 msec was applied to each of the electron-emitting devices with a frequency of f=60 Hz.

The pulse wave height was held to 6V for ten minutes, during which the device current gradually fell. Thereafter, the pulse width was changed to T=500 sec. When the resistance of each X-directional wire determined from the pulse wave height and the device current exceeded 16.7 kΩ (or a resistance of 1 MΩ for each device), the application of the pulse voltage was terminated.

Method B:

After evacuating the envelope 88 as in the case of Method A above, $H_2$ gas was introduced into it until the pressure got to 1.3 Pa.

Thereafter, a pulse voltage same as that of Method A was applied and the wave height was held to 6V for 10 minutes to find that the resistance of each X-directional wire determined from the pulse wave height and the device current exceeded 16.7 kΩ and the application of the pulse voltage was terminated at that moment. Then, the envelope was evacuated again.

Method C:

After evacuating the envelope 88 as in the case of Method A above, only Dox1 of the X-directional wires was connected to the pulse generator 1402 to apply a pulse voltage with a pulse width of T1=100 μm and a pulse interval of T2=16.7 msec was applied to each of the electron-emitting devices with a frequency of f=60 Hz. As the case of Method A, the pulse wave height was held to 6V for ten minutes and, thereafter, the pulse width was changed to T1=500 μsec. When the resistance of the X-directional wire exceeded 16.7 kΩ, the application of the pulse voltage was terminated. Then, the switching circuit was operated to select the next device row for another energization forming operation. This procedure was repeated until all the 20 device rows were treated for energization forming.

Method D:

After evacuating the envelope 88 as in the case of Method A above, a pulse voltage with a pulse width of T1=100 μsec and a pulse interval of T2=833 μsec was applied to each of the electron-emitting devices. Switching circuit was operated in a manner as in the case of Method A. Thus, like Method A, a pulse voltage with a pulse width of T1=100 μsec and a pulse interval of T2=16.7 msec was applied to each of the electron-emitting devices with a frequency of f=60 Hz.

The pulse wave height was raised stepwise with a step of 0.1V. When the wave height got to 12V, the resistance of each of the devices exceeded 16.7 kΩ so that the application of the pulse voltage was suspended.

In the electron-emitting region 2 of each of the processed devices, a uniform fissure of 10 nm (Method B) or 15 nm (Method A or C) was observed. In the Comparative Example 8, the fissure width was uneven and fluctuated between 100 and 200 nm.

Thereafter, the devices were subjected to an activation process by applying a pulse voltage thereto. In the Example 14 group, a rectangular pulse voltage having the pulse width and pulse interval described by referring to Method A was used but a wave height of 15V was selected. Acetone was introduced into the envelope 88 until the internal pressure got to $1.3\times10^{-2}$ Pa, while observing the device current If.

Subsequently, a stabilization process was carried out. In this process, the envelope 88was heated to 160° C. and evacuated until the internal pressure fell to $1.3\times10^{-5}$ Pa. Then, the exhaust pipe (not shown) was closed by melting it with a gas burner to hermetically seal the envelope 88. A getter treatment was conducted by means of a high frequency heating technique in order to maintain the inside of the envelop to that degree of vacuum.

Each of the prepared image-forming apparatus was then driven to operate by applying a scan signal and a modulation signal from a signal generator (not shown) by way of the external terminals Dox1 through Dox20 and Doy1 through Doy60 so that a voltage was applied to each of the electron-emitting devices 74 to cause it emit electrons. At the same time, a high voltage of 7 kV was applied to the metal back 85 by way of the high voltage terminal Hv in order to accelerate the electron beams until they collided with and excited the fluorescent film 84, which by turn fluoresced to produce fine and excellent images on a stable basis.

At the same time the current running into the high voltage terminal Hv and the emission current Ie were measured. For each apparatus, the variances ΔIe and the average Ie and of each device row (60 devices) are shown in Table 12 below.

TABLE 12

| | method | Ie (μA) | ΩIe (%) |
|---|---|---|---|
| Example 14-1 | A | 90 | 5 |
| Example 14-2 | B | 120 | 5 |
| Example 14-3 | C | 90 | 5 |
| Com. Ex. 8 | D | 60 | 15 |

ΔIe of the electron source of each of Examples 14-1 through 14-3 was very small when compared with its counterpart of the electron source of Comparative Example 8 to prove the uniformity of the electron-emitting devices. The electron-emitting devices of the electron source of each of the Examples 14-1 through 14-3 maintained the given pulse wave height Vh (6V) during the energization forming process, whereas those of the electron source of Comparative Example 8 showed remarkable variances between 0 and 12V. The variances in the resistance of the devices (prior to energization forming) were reflected to the variances in the voltage applied to the electron-emitting devices. Additionally, the pulse voltage used in Example 8 was higher than its counterpart of the Examples 14 group.

[Example 15]

Figure 17:
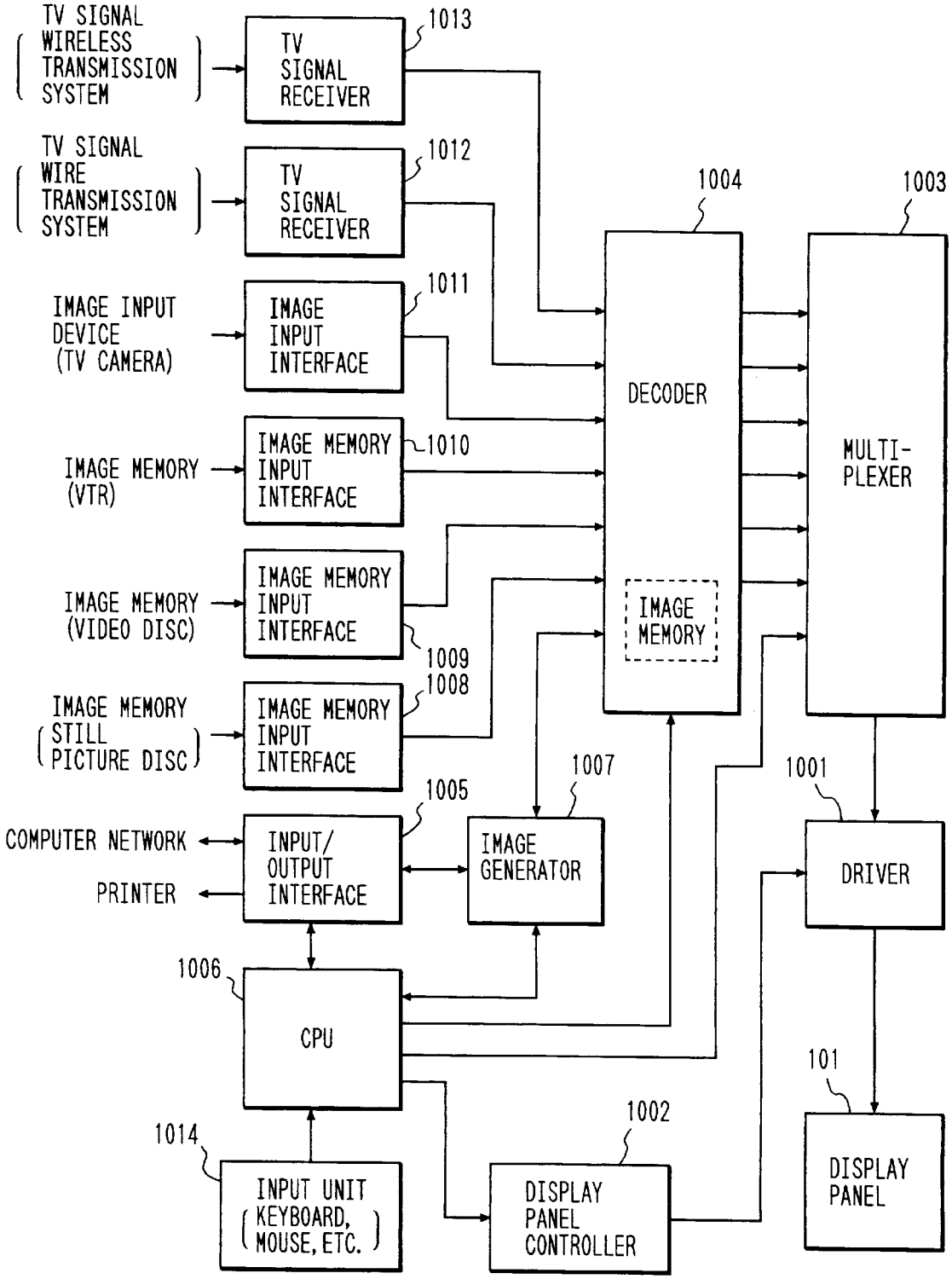
FIG. 17 is a schematic block diagram of an image display system realized by using an image-forming apparatus according to the invention.
Figure 18:
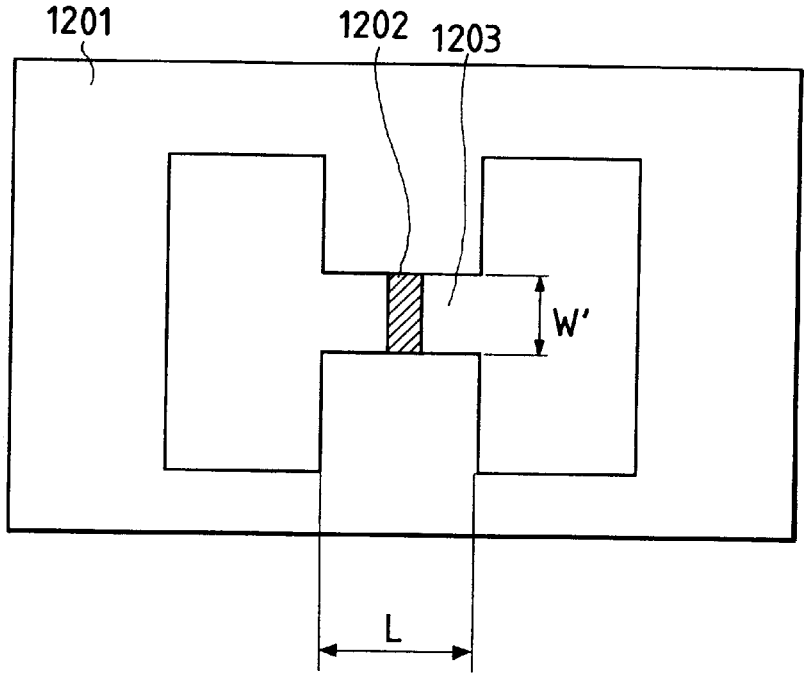
FIG. 18 is a schematic plan view of a known surface conduction electron-emitting device.

FIG. 17 is a block diagram of a display apparatus realized by using a method according to the invention and a display panel prepared in Example 14 and arranged to provide visual information coming from a variety of sources of information including television transmission and other image sources.

In FIG. 17, there are shown a display panel 1001, a display panel driver 1002, a display panel controller 1003, a multiplexer 1004, a decoder 1005, an input/output interface circuit 1006, a CPU 1007, an image generator 1008, image input memory interface circuits 1009, 1010 and 1011, an image input interface circuit 1012, TV signal receivers 1013 and 1014 and an input unit 1015. (If the display apparatus is used for receiving television signals that are constituted by video and audio signals, circuits, speakers and other devices are required for receiving, separating, reproducing, processing and storing audio signals along with the circuits shown in the drawing. However, such circuits and devices are omitted here in view of the scope of the present invention.)

Now, the components of the apparatus will be described, following the flow of image signals therethrough.

Firstly, the TV signal receiver 1014 is a circuit for receiving TV image signals transmitted via a wireless transmission system using electromagnetic waves and/or spatial optical telecommunication networks. The TV signal system to be used is not limited to a particular one and any system such as NTSC, PAL or SECAM may feasibly be used with it. It is particularly suited for TV signals involving a larger number of scanning lines (typically of a high definition TV system such as the MUSE system) because it can be used for a large display panel 1001 comprising a large number of pixels. The TV signals received by the TV signal receiver 1014 are forwarded to the decoder 1005.

The TV signal receiver 1013 is a circuit for receiving TV image signals transmitted via a wired transmission system using coaxial cables and/or optical fibers. Like the TV signal receiver 1014, the TV signal system to be used is not limited to a particular one and the TV signals received by the circuit are forwarded to the decoder 1005.

The image input interface circuit 1012 is a circuit for receiving image signals forwarded from an image input device such as a TV camera or an image pick-up scanner. It also forwards the received image signals to the decoder 1005.

The image input memory interface circuit 1011 is a circuit for retrieving image signals stored in a video tape recorder (hereinafter referred to as VTR) and the retrieved image signals are also forwarded to the decoder 1005.

The image input memory interface circuit 1010 is a circuit for retrieving image signals stored in a video disc and the retrieved image signals are also forwarded to the decoder 1005.

The image input memory interface circuit 1009 is a circuit for retrieving image signals stored in a device for storing still image data such as so-called still disc and the retrieved image signals are also forwarded to the decoder 1005.

The input/output interface circuit 1006 is a circuit for connecting the display apparatus and an external output signal source such as a computer, a computer network or a printer. It carries out input/output operations for image data and data on characters and graphics and, if appropriate, for control signals and numerical data between the CPU 1007 of the display apparatus and an external output signal source.

The image generation circuit 1008 is a circuit for generating image data to be displayed on the display screen on the basis of the image data and the data on characters and graphics input from an external output signal source via the input/output interface circuit 1006 or those coming from the CPU 1007. The circuit comprises reloadable memories for storing image data and data on characters and graphics, read-only memories for storing image patterns corresponding given character codes, a processor for processing image data and other circuit components necessary for the generation of screen images.

Image data generated by the image generation circuit 1008 for display are sent to the decoder 1005 and, if appropriate, they may also be sent to an external circuit such as a computer network or a printer via the input/output interface circuit 1006.

The CPU 1007 controls the display apparatus and carries out the operation of generating, selecting and editing images to be displayed on the display screen.

For example, the CPU 1007 sends control signals to the multiplexer 1004 and appropriately selects or combines signals for images to be displayed on the display screen. At the same time it generates control signals for the display panel controller 1003 and controls the operation of the display apparatus in terms of image display frequency, scanning method (e.g., interlaced scanning or non-interlaced scanning), the number of scanning lines per frame and so on.

The CPU 1007 also sends out image data and data on characters and graphic directly to the image generation circuit 1008 and accesses external computers and memories via the input/output interface circuit 1006 to obtain external image data and data on characters and graphics. The CPU 1007 may additionally be so designed as to participate other operations of the display apparatus including the operation of generating and processing data like the CPU of a personal computer or a word processor. The CPU 1007 may also be connected to an external computer network via the input/output interface circuit 1006 to carry out computations and other operations, cooperating therewith.

The input unit 1015 is used for forwarding the instructions, programs and data given to it by the operator to the CPU 1007. As a matter of fact, it may be selected from a variety of input devices such as keyboards, mice, joysticks, bar code readers and voice recognition devices as well as any combinations thereof.

The decoder 1005 is a circuit for converting various image signals input via said circuits 1008 through 1014 back into signals for three primary colors, luminance signals and I and Q signals. Preferably, the decoder 1005 comprises image memories as indicated by a dotted line in FIGS. 22A to 22C for dealing with television signals such as those of the MUSE system that require image memories for signal conversion. The provision of image memories additionally facilitates the display of still images as well as such operations as thinning out, interpolating, enlarging, reducing, synthesizing and editing frames to be optionally carried out by the decoder 1005 in cooperation with the image generation circuit 1008 and the CPU 1007. The multiplexer 1004 is used to appropriately select images to be displayed on the display screen according to control signals given by the CPU 1007. In other words, the multiplexer 1004 selects certain converted image signals coming from the decoder 1005 and sends them to the drive circuit 1002.

It can also divide the display screen in a plurality of frames to display different images simultaneously by switching from a set of image signals to a different set of image signals within the time period for displaying a single frame.

The display panel controller 1003 is a circuit for controlling the operation of the drive circuit 1002 according to control signals transmitted from the CPU 1007.

Among others, it operates to transmit signals to the drive circuit 1002 for controlling the sequence of operations of the power source (not shown) for driving the display panel in order to define the basic operation of the display panel. It also transmits signals to the drive circuit 1001 for controlling the image display frequency and the scanning method (e.g., interlaced scanning or non-interlaced scanning) in order to define the mode of driving the display panel. If appropriate, it also transmits signals to the drive circuit 1002 for controlling the quality of the images to be displayed on the display screen in terms of luminance, contrast, color tone and sharpness.

If appropriate, the display panel controller 1003 transmits control signals for controlling the quality of the image being displayed in terms of brightness, contrast, color tone and/or sharpness of the image to the drive circuit 1002.

The drive circuit 1002 is a circuit for generating drive signals to be applied to the display panel 1001.

It operates according to image signals coming from said multiplexer 1004 and control signals coming from the display panel controller 1003.

A display apparatus according to the invention and having a configuration as described above and illustrated in FIGS. 22A to 22C can display on the display panel 1001 various images given from a variety of image data sources. More specifically, image signals such as television image signals are converted back by the decoder 1005 and then selected by the multiplexer 1004 before sent to the drive circuit 1002. On the other hand, the display controller 1003 generates control signals for controlling the operation of the drive circuit 1002 according to the image signals for the images to be displayed on the display panel 1001. The drive circuit 1002 then applies drive signals to the display panel 1001 according to the image signals and the control signals. Thus, images are displayed on the display panel 1001. All the above described operations are controlled by the CPU 1007 in a coordinated manner.

As described above in detail, the present invention provides an electron-emitting device that comprises a large number of electron-emitting devices and operates stably for electron emission as well as an electron source comprising a large number of such devices and an image-forming apparatus incorporating such an electron source that can display images of excellent quality.

What is claimed is:

1. An electron-emitting device, comprising:

a pair of electrodes on a substrate;

an electroconductive film connecting said electrodes; and a fissure formed at a part of said electroconductive film, wherein the fissure has a width of a median value not greater than 50 nm, and wherein the width of the fissure, at locations amounting to not less than 70% of the entire length of the fissure, is within +20% of the median value.

2. An electron-emitting device according to claim 1, wherein said device shows a voltage applicable length of less than 5 nm in the electron-emitting region.

3. An electron-emitting device according to claim 1, wherein the electron-emitting region carries a coating film made of a material different from that of the electroconductive thin film.

4. An electron-emitting device according to claim 3, wherein the material of said coating film of the electron-emitting region is carbon, a carbon compound or a mixture thereof.

5. An electron-emitting device according to claim 3, wherein the material of said coating film of the electron-emitting region is metal, a metal compound or a mixture thereof.

6. An electron source, comprising a plurality of electron-emitting devices according to any of claims 1 through 5.

7. An electron source according to claim 6, wherein said source comprises one or more than one rows having a plurality of electron-emitting devices and a matrix wiring arrangement for driving each of the electron-emitting devices.

8. An electron source according to claim 6, wherein said source comprises one or more than one rows having a plurality of electron-emitting devices and a ladder-like wiring arrangement for driving each of the electron-emitting devices.

9. An image-forming apparatus, said apparatus comprises an electron source according to claim 6 and an image forming member for forming images when irradiated with electron beams emitted from the electron source.

10. An image-forming apparatus, said apparatus comprises an electron source according to claim 6, control means for controlling ON/OFF and the intensity of electron beams emitted from the electron source and an image forming member for forming images when irradiated with electron beams emitted from the electron source.

* * * * *

UNITED STATES PATENT AND TRADEMARK OFFICE

CERTIFICATE OF CORRECTION

PATENT NO. : 6,034,478
DATED : March 7, 2000
INVENTOR(S) : Hisaaki Kawade, et al.

It is certified that error appears in the above-identified patent and that said Letters Patent is hereby corrected as shown below:

Column 5
Line 51, "cross sectional" should read --cross-sectional--;
Line 54, "cross sectional" should read --cross-sectional--;
Line 57, "cross sectional" should read --cross-sectional--.

Column 6
Line 27, "cross sectional" should read --cross-sectional--;
Line 30, "cross sec-" should read --cross-sec---;
Line 55, after line 55, insert ¶--Fig. 24 is a graph showing the typical schematic relationship between the voltage and the resistance observed in the energization forming process of the surface conduction electron-emitting device of the prior art--.

Column 8
Line 29, " "The Ultrafine" should read --¶ "The Ultrafine--.

Column 9
Line 11, "onion" should read --on an--;
Line 53, "pictures" should read --picture--.

Column 10
Line 28, "seem" should read --seems--.

UNITED STATES PATENT AND TRADEMARK OFFICE

CERTIFICATE OF CORRECTION

PATENT NO. : 6,034,478
DATED : March 7, 2000
INVENTOR(S) : Hisaaki Kawade, et al.

It is certified that error appears in the above-identified patent and that said Letters Patent is hereby corrected as shown below:

Column 13
Line 18, "benzen" should read --benzene--.

Column 14
Line 28, "tens of several" should read --several tens of--.

Column 15
Line 36, "follows" should read --follow--.

Column 16
Line 34, "is increases" should read --is increased--.

Column 17
Line 7, "to" should read --to as--.

Column 18
Line 64, "denotes" should read --denote--.

Column 19
Line 17, "to comprise for" should read --to be capable of--;
Line 30, "is" should read --can--.

Column 20
Line 62, "circuits" should read --circuit--.

UNITED STATES PATENT AND TRADEMARK OFFICE

CERTIFICATE OF CORRECTION

PATENT NO. : 6,034,478
DATED : March 7, 2000
INVENTOR(S) : Hisaaki Kawade, et al.

It is certified that error appears in the above-identified patent and that said Letters Patent is hereby corrected as shown below:

Column 23
Line 38, "an" should read --a--.

Column 24
Line 65, "was" should read --were--.

Column 25
Table 1, "$I_{form}(^{mA})$" should read --$I_{form}$(mA)--.

Column 26
Line 46, "example," should read --examples,--;
Line 51, "cross-sectional" should read --cross-sectional--;
Line 56, "denotes" should read --denote--.

Column 27
Line 2, "plate" should read --plate,--;
Line 39, "was" should read --were--.

Column 28
Line 22, "is" should be deleted;
Line 45, "by" should be deleted.

Column 29
Line 29, "excellent" should read --more excellent--.

UNITED STATES PATENT AND TRADEMARK OFFICE

CERTIFICATE OF CORRECTION

PATENT NO. : 6,034,478
DATED : March 7, 2000
INVENTOR(S) : Hisaaki Kawade, et al.

It is certified that error appears in the above-identified patent and that said Letters Patent is hereby corrected as shown below:

Column 32
Line 7, "device," should read --devices,--.

Column 36
Line 29, "realized" should read --realize--;
Line 30, "1.3X $^{-1}$Pa." should read --1.3X$10^{-1}$ Pa.--.

Column 43
Line 5, "within + 20%" should read --within ± 20%--.

Column 44
Line 11, "said" should read --wherein said--;
Line 15, "said" should read --wherein said--.

Signed and Sealed this

Twelfth Day of June, 2001

Nicholas P. Godici

*Attest:*

*Attesting Officer*

NICHOLAS P. GODICI
*Acting Director of the United States Patent and Trademark Office*